US007642029B2

(12) United States Patent
Horgan et al.

(10) Patent No.: US 7,642,029 B2
(45) **Date of Patent: *Jan. 5, 2010**

(54) IMAGING MEMBER

(75) Inventors: Anthony M. Horgan, Pittsford, NY (US); Robert C. U. Yu, Webster, NY (US); Kathleen M. Carmichael, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 453 days.

This patent is subject to a terminal disclaimer.

(21) Appl. No.: 11/262,401

(22) Filed: Oct. 28, 2005

(65) Prior Publication Data

US 2007/0099101 A1 May 3, 2007

(51) Int. Cl.
*G03G 5/047* (2006.01)

(52) U.S. Cl. ..... 430/58.8; 430/58.65; 430/58.75; 430/59.6; 399/159

(58) Field of Classification Search ..... 430/58.65, 430/58.75, 58.8, 59.6; 399/159
See application file for complete search history.

(56) References Cited

U.S. PATENT DOCUMENTS

| | | | | |
|---|---|---|---|---|
| 3,121,006 | A | | 2/1964 | Middleton et al. |
| 3,357,989 | A | | 12/1967 | Byrne et al. |
| 3,443,781 | A | | 5/1969 | Weinberger |
| 3,870,516 | A | | 3/1975 | Smith et al. |
| 3,972,717 | A | | 8/1976 | Wiedemann |
| 4,233,384 | A | | 11/1980 | Turner et al. |
| 4,265,990 | A | | 5/1981 | Stolka et al. |
| 4,286,033 | A | | 8/1981 | Neyhart et al. |
| 4,291,110 | A | | 9/1981 | Lee |
| 4,299,987 | A | | 11/1981 | Stolka et al. |
| 4,302,521 | A | | 11/1981 | Takei et al. |
| 4,306,008 | A | | 12/1981 | Pai et al. |
| 4,338,387 | A | | 7/1982 | Hewitt |
| 4,415,639 | A | | 11/1983 | Horgan |
| 4,439,507 | A | | 3/1984 | Pan et al. |
| 4,725,518 | A | * | 2/1988 | Carmichael et al. ..... 430/58.75 |
| 4,786,570 | A | | 11/1988 | Yu et al. |
| 4,801,517 | A | | 1/1989 | Frechet et al. |
| 4,806,443 | A | | 2/1989 | Yanus et al. |
| 4,806,444 | A | | 2/1989 | Yanus et al. |
| 4,818,650 | A | | 4/1989 | Limburg et al. |
| 4,937,117 | A | | 6/1990 | Yu |
| 4,983,481 | A | | 1/1991 | Yu |
| 5,021,309 | A | | 6/1991 | Yu |
| 5,030,532 | A | | 7/1991 | Limburg et al. |
| 5,089,369 | A | | 2/1992 | Yu |
| 5,167,987 | A | | 12/1992 | Yu |
| 5,774,767 | A | * | 6/1998 | Shibata et al. ..... 399/167 |
| 6,010,810 | A | * | 1/2000 | Uesaka et al. ..... 430/58.8 |
| 2002/0160294 | A1 | * | 10/2002 | Okuno et al. ..... 430/124 |
| 2003/0049551 | A1 | * | 3/2003 | Parikh et al. ..... 430/58.65 |
| 2004/0096761 | A1 | * | 5/2004 | Lin et al. ..... 430/58.15 |
| 2007/0172749 | A1 | * | 7/2007 | Carmichael et al. ..... 430/58.8 |

* cited by examiner

*Primary Examiner*—Mark F Huff
*Assistant Examiner*—Rachel L Burney
(74) *Attorney, Agent, or Firm*—Fay Sharpe LLP

(57) ABSTRACT

A flexible imaging member which does not require the use of an anti-curl back coating is disclosed herein. The flexible imaging member has a layer comprising two charge transport molecules dispersed in a film-forming polymer binder and an overcoat layer. The first charge transport molecule is a biphenyl amine, terphenyl diamine, or bis(triarylamine) stilbene. The second charge transport molecule is a bis(triarylamine), tri-p-tolylamine, or triphenylamine. The weight ratio of second charge transport molecule to first charge transport molecule is from about 90:10 to about 66:34. Trifluoro acetic acid is also added to the layer containing the charge transport material.

19 Claims, 7 Drawing Sheets

IMAGING MEMBER

CROSS-REFERENCE TO RELATED APPLICATIONS

This application is related to copending U.S. application Ser. No. 11/261,338, filed Oct. 28, 2005, entitled "Imaging Members", the disclosure of which is totally incorporated herein by reference.

BACKGROUND

This disclosure relates, in various embodiments, to electrophotographic imaging members. The imaging members described herein can be used as photosensitive members, photoreceptors or photoconductors useful in electrophotographic systems, including printers, copiers, other reproductive devices, and digital apparatuses. More particularly, the imaging members of this disclosure do not require an anti-curl back coating to maintain flatness, etc., and comprise at least a flexible substrate and a layer comprising a charge transport material having certain characteristics. The disclosure also relates to methods of imaging utilizing such imaging members.

Electrophotographic imaging members, such as photoreceptors or photoconductors, typically include a photoconductive layer formed on an electrically conductive substrate or formed on layers between the substrate and photoconductive layer. The photoconductive layer is an insulator in the dark, so that during machine imaging processes, electric charges are retained on its surface. Upon exposure to light, the charge is dissipated, and an image can be formed thereon, developed using a developer material, transferred to a copy substrate, and fused thereto to form a copy or print. Electrophotographic imaging members are typically in either a flexible belt configuration or rigid drum form. Flexible imaging member belts may either be seamed or seamless belts. However, for reasons of simplicity, the disclosure hereinafter will focus only on electrophotographic imaging members in a flexible belt configuration.

For typical negatively-charged flexible electrophotographic imaging member belts, the outermost exposed photoconductive layer is a charge transport layer. Therefore, under normal machine service conditions, the charge transport layer is repeatedly subjected to various machine subsystems mechanical interactions and constantly exposed to corona effluents (emitted from a charging device) and other volatile organic compound (VOC) species/contaminants. Mechanical interactions against imaging member cause the charge transport layer to develop wear, abrasion, and scratch. Wear reduces the charge transport layer thickness, effectively changing the charging field strength. Scratches manifest themselves as printout defects. Exposure to corona effluents and chemical contaminants gives rise to charge transport layer material degradation and lateral charge migration (LCM) problems. Charge transport layer material degradation facilitates the premature onset of layer cracking and LCM. All of these physical and mechanical failures impact copy image quality and cut short the intended functional life of an electrophotographic imaging member belt, requiring frequent and costly belt replacement.

In a service environment, a flexible imaging member belt, mounted on a belt supporting module, is exposed to repetitive electrophotographic image cycling which subjects the outermost charge transport layer to mechanical fatigue as the imaging member belt bends and flexes over the belt drive roller and all other belt module support rollers, as well as sliding bend contact above each backer bar's curving surface. This repetitive imaging member belt cycling leads to a gradual deterioration in the physical and mechanical integrity of the exposed outer charge transport layer leading to premature onset of fatigue charge transport layer cracking. The cracks developed in the charge transport layer as a result of dynamic belt fatiguing manifest themselves as copy printout defects which adversely affect image quality. In essence, the appearance of charge transport cracking cuts short the imaging member belt's intended functional life.

Many advanced imaging systems are based on the use of a flexible imaging member belt mounted over and around a belt support module design employing small diameter belt rollers. Although small diameter for belt module support rollers are used to provide easy paper self-stripping, the benefit of easy paper copy stripping negated by the large charge transport layer bending strain induced during dynamic fatigue belt flexing/bending motions over the small belt module support roller during image member belt machine functioning. The large bending strain induced by each small belt support module roller aggravates the mechanical problems that lead to early onset of charge transport layer cracking. Moreover, charge transport layer cracking frequently occurs at those belt segments parked over the support rollers during prolonged machine idling or overnight/weekend shut off periods as a result of exposure to residual corona effluents and airborne chemical contaminants. The early onset of charge transport layer cracking is a serious issue that impacts copy printout quality.

For typical negatively-charged imaging member belts, such as flexible photoreceptor belt designs, there are multiple layers comprised of a flexible supporting substrate, a conductive ground plane, a charge blocking layer, an optional adhesive layer, a charge generating layer, and an outermost exposed charge transport layer. The charge transport layer is usually the last layer to be coated and is applied by solution coating followed by drying at elevated temperatures, then cooling to ambient room temperature. When a production web stock of several thousand feet of coated multilayered photoreceptor material is obtained after finishing the charge transport layer coating and drying/cooling process, upward curling of the multilayered photoreceptor is observed.

This upward curling has been determined to be the consequence of thermal contraction mismatch between the applied charge transport layer and the substrate support. Because the charge transport layer in a typical conventional photoreceptor device, using polycarbonate as binder, has a coefficient of thermal contraction approximately 3.7 times greater than that of the flexible substrate support (usually a polyethylene naphthalate or a polyethylene terephthalate), the charge transport layer has a greater dimensional contraction than that of the substrate support as it cools down to ambient room temperature. The resulting internal tension strain in the charge transport layer causes the photoreceptor to exhibit upward curling. If unrestrained, the photoreceptor would spontaneously curl upwardly such as into a 1.5-inch tube. To offset this curl and keep the photoreceptor web stock flat, an anti-curl back coating (ACBC) is applied to the backside of the flexible substrate support, opposite to the side having the charge transport layer.

Although an ACBC is required to keep the photoreceptor flat, its application represents more than just an additional coating step. It increases the labor and material cost and also decreases daily photoreceptor production through-put by about 25%. Moreover, the ACBC coating application frequently results in photoreceptor production yield lost due to web stock scratching damage caused by handling. In addition, the use of an ACBC has also been determined to cause an internal built-in strain of about 0.28% in the charge transport layer. This internal strain is cumulatively added onto each photoreceptor bending induced strain as the photoreceptor belt flexes over a variety of belt module support rollers during dynamic belt cycling function within a machine. Consequently, this internal built-in strain compounds and exacerbates the fatigue bending strain in the charge transport layer, causing early onset of charge transport layer cracking.

Seamed flexible photoreceptor belts are fabricated from sheets cut from an electrophotographic imaging member web stock having anti-curl back coating. The cut sheets are generally rectangular in shape. All edges may be of the same length or one pair of parallel edges may be longer than the other pair of parallel edges. The sheet is formed into a belt by joining the overlapping opposite marginal end regions of the sheet. A seam is typically produced in the overlapping opposite marginal end regions at the point of joining. Joining may be effected by means such as welding (including ultrasonic processes), gluing, taping, or pressure/heat fusing. However, ultrasonic seam welding is generally the preferred method of joining because it is rapid, clean (no application of solvents) and produces a thin and narrow seam. The ultrasonic seam welding process involves a mechanical pounding action of a welding horn which generates a sufficient amount of heat energy at the contiguous overlapping marginal end regions of the imaging member sheet to maximize melting of one or more layers therein. A typical ultrasonic welding process is carried out by pressing down the overlapping ends of the flexible imaging member sheet onto a flat anvil and guiding the flat end of the ultrasonic vibrating horn transversely across the width of the sheet and directly over the overlapped junction to form a welded seam having two adjacent seam splashings consisting of the molten mass of the imaging member layers ejected to either side of the welded overlapped seam.

These seam splashings of the ejected molten mass comprise about 40% by weight of the anti-curl back coating material. Seam splashings are undesirable projection features because they interfere with cleaning blade action, causing blade damage and wear which leads to premature loss of cleaning efficiency. The seam splashing present at the back side of the photoreceptor belt has also been found to physically interact with the belt support module roller, affecting the photoreceptor belt's delicate motion/cycling speed during an imaging process and impacting toner image formation as reflected in the copy printout quality.

Another disadvantage of an ACBC is that the ACBC is in constant mechanical interaction with the machine belt support rollers and backer bars; this causes substantial wear of the ACBC. The ACBC may also be susceptible to degradation by ozone attack, which also accelerates wear. ACBC wear generates dust inside the machine cavity and reduces the thickness of the anti-curl layer, diminishing its ability to keep the photoreceptor belt flat. This upward belt curling, caused by loss of ACBC thickness, produces significant surface distance variation between the photoreceptor belt surface and the machine charging device; this variation causes non-uniform charging density over the photoreceptor belt surface, degrading copy printout quality.

In addition, photoreceptor belt upward curling under dynamic belt functioning conditions causes the belt to physically interact/interfere with the xerographic subsystems, particularly in those machines employing a hybrid scavengeless development (HSD) or hybrid jumping development (HJD) subsystem. This interaction leads causes undesirable artifacts which manifest themselves as printout defects.

With the noted undesirable traits described above, it is clear that flexible seamed photoreceptor belts which do not require an ACBC can reduce the belt unit manufacturing cost, increase belt yield and daily production throughput, provide extended service life, and suppress of early onset of charge transport layer cracking by eliminating internal strain.

In U.S. Pat. No. 5,089,369 to R. Yu, issued on Feb. 18, 1992, the disclosure of which is fully incorporated herein by reference, an electrophotographic imaging member having a supporting substrate and a charge generating layer, the supporting substrate material having a thermal contraction coefficient which is about the same as that of the charge generating layer, is disclosed. Substrate materials that have a thermal contraction coefficient value from about $5.0\times10^{-5}/°$ C. to about $9.0\times10^{-5}/°$ C. are used in combination with a benzimidazole perylene charge generating layer.

U.S. Pat. No. 5,167,987 to R. Yu, issued on Dec. 1, 1992, discloses a process for fabricating an electrostatographic imaging member including providing a flexible substrate comprising a solid thermoplastic polymer, forming an imaging layer coating including a film forming polymer on the substrate, heating the coating and substrate, cooling the coating and substrate, and applying sufficient predetermined biaxial tensions to the substrate while the imaging layer coating and substrate are at a temperature greater than the Glass Transition Temperature (Tg) of the imaging layer coating to substantially compensate for all dimensional thermal contraction mismatches between the substrate and the imaging layer coating during cooling of the imaging layer coating and the substrate, removing application of the biaxial tensions to the substrate, and cooling the substrate whereby the final hardened and cooled imaging layer coating and substrate are free of internal stress and strain. The disclosure of the '987 patent is also fully incorporated herein by reference.

U.S. Pat. No. 4,983,481 to R. Yu, issued on Jan. 8, 1991, discloses an imaging member without an anti-curl backing layer having improved resistance to curling. The imaging member comprises a flexible supporting substrate layer, an electrically conductive layer, an optional adhesive layer, a charge generating layer, and a charge transport layer, the supporting substrate layer having a thermal contraction coefficient substantially identical to the thermal contraction coefficient of the charge transport layer. The supporting substrate may be a flexible biaxially oriented layer. The disclosure of this patent is further fully incorporated herein by reference.

While the above mentioned curl-free flexible imaging members having no ACBC may be useful for their intended purpose of resolving specific problems, resolution of one problem has often been found to create new ones. For example, the selection of a supporting substrate having thermal contraction matching that of the charge transport layer has been observed to be susceptible to attack and damage by solvents used in the charge transport layer coating solution, rendering the imaging member useless. Other substrate supports have good thermal contraction matching properties but also have inherently low glass transition temperatures (Tg) which are not suitable for imaging member fabrication. Applying biaxial tensioning stress onto imaging members maintained at a temperature slightly above the glass transition temperature (Tg) of the charge transport layer is a costly and cumbersome batch process.

There continues to be a need for improved imaging members, especially flexible imaging member belts, which do not have an ACBC, wherein the layer comprising the charge transport material has little or no internal built-in strain, is less susceptible to cracking induced by fatigue bending, and is less susceptible to material failure from exposure to corona effluents and airborne chemical contaminants.

SUMMARY

Disclosed herein, in various embodiments, are photoconductive imaging members having a flexible substrate, at least a layer comprising a charge transport material, and an overcoat layer. The imaging members are configured in such a manner to avoid the usage of an anti-curl back coating layer. Also disclosed herein are methods of imaging utilizing such imaging members.

In one embodiment of the present disclosure, an imaging member having the desired flatness without the use of an anti-curl back coating (ACBC) is provided. The imaging member comprises a substrate, a layer comprising a charge transport material, such as a charge transport layer having little or no internal strain, and an overcoat layer. The charge transport layer comprises a blend of two charge transport molecules and trifluoro acetic acid (TFA) molecularly dispersed or dissolved in a film forming polymer binder to form a thermoplastic solid solution. In additional embodiments, the charge transport layer has a glass transition temperature (Tg) of from about 30° C. to about 65° C. and from about 35° C. to about 45° C. The difference in thermal contraction coefficient between the charge transport layer and the substrate is in the amount of from about $+2\times10^{-5}$/° C. and about $-0.5\times10^{-5}$/° C. in the temperature range between the Tg of the charge transport layer and 25° C. (or ambient room temperature). In other embodiments, the imaging member comprises a flexible substrate, a charge generating layer, a charge transport layer having the characteristics noted above, and an overcoat layer.

The first charge transport molecule is a biphenyl diamine, a terphenyl diamine, or a bis(triarylamine) stilbene. The biphenyl diamine is represented by Formula (I) below:

Formula (I)

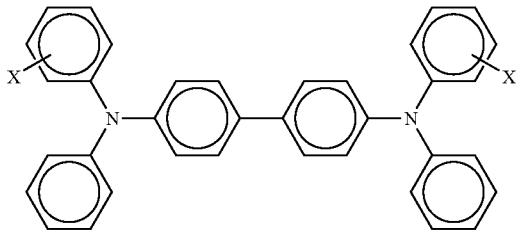

wherein X is selected from the group consisting of alkyl, hydroxyl, and halogen.

The terphenyl diamine is represented by Formula (II) below:

Formula (II)

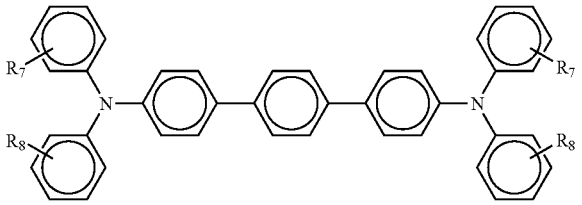

wherein $R_7$ and $R_8$ are independently selected from alkyl, hydroxyl, and halogen. In a specific embodiment, $R_7$ and $R_8$ are methyl groups attached to the ortho position of each phenyl ring.

The bis(triarylamine) stilbene is represented by Formula (III) below:

Formula (III)

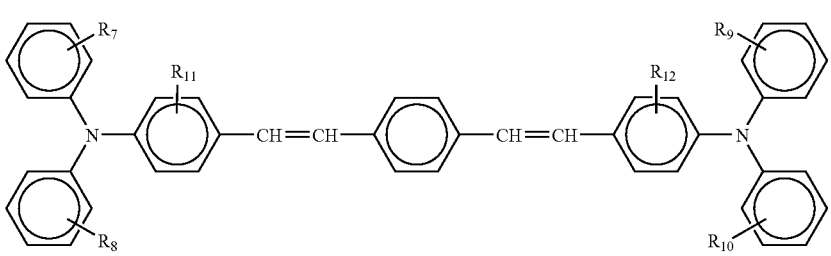

wherein $R_7$ through $R_{12}$ are independently selected from the group consisting of hydrogen, halogen, alkyl having 1 to 3 carbon atoms, aryl having 6 to 10 carbon atoms, and cycloalkyl having 3 to 18 carbon atoms.

The second charge transport molecule is selected from the group consisting of a bis(triarylamine), 1,1-bis(4-di-p-tolylaminophenyl)cyclohexane, tri-p-tolylamine, and triphenylamine as shown in Formulas (IV) to (VII) below. The bis (triarylamine) is represented by Formula (IV) below:

Formula (IV)

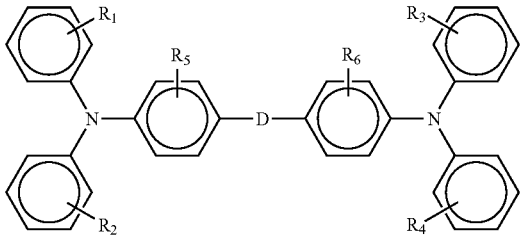

wherein $R_1$ through $R_6$ are independently selected from alkyl having 1 to 3 carbon atoms and hydrogen; and wherein D is a divalent linkage selected from —O—, saturated or unsaturated alkyl having 1 to 8 carbon atoms, substituted alkyl having 1 to 8 carbon atoms, and cycloalkyl having 1 to 6 carbon atoms, wherein D is not phenyl.

In a specific embodiment, D is cyclohexane; $R_1$ through $R_4$ are methyl in the para position; and $R_5$ and $R_6$ are hydrogen. In this embodiment, the bis(triarylamine) of Formula (IV) is 1,1-bis(4-di-p-tolylaminophenyl) cyclohexane represented by Formula (V) below:

Formula (V)

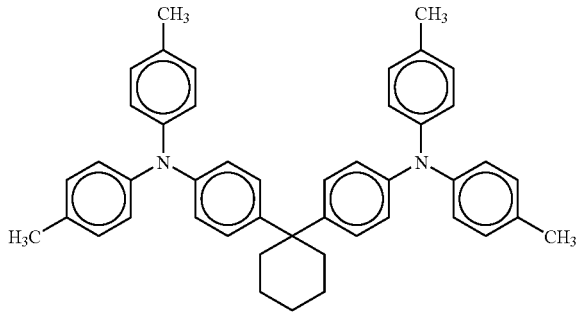

Tri-p-tolylamine is shown in Formula (VI) and triphenylamine is shown in Formula (VII) below:

Formula (VI)

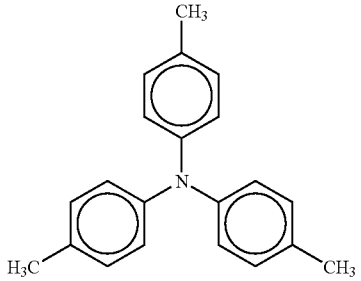

-continued

Formula (VII)

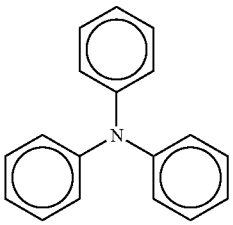

In other embodiments, the film-forming polycarbonate binder used in the charge transport layer is a poly(4,4'-isopropylidene diphenyl) carbonate represented by Formula (VIII) below, Formula (VIII)

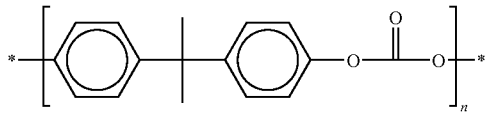

or a poly(4,4'-diphenyl-1,1'-cyclohexane) carbonate represented by Formula (IX) below, Formula (IX)

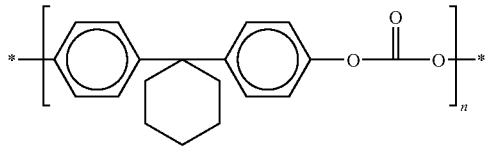

or a polyphthalate carbonate represented by Formula (X) below:

Formula (X)

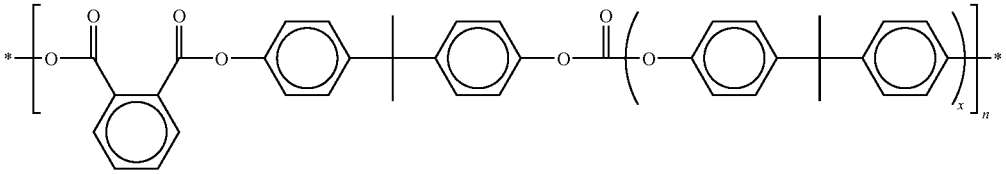

wherein x is an integer from about 1 to about 10, and n is the degree of polymerization.

In still another embodiment, the disclosure relates to an imaging member lacking an anti-curl back coating. The imaging member comprises a flexible substrate, wherein an electrically conductive layer is present when the substrate is not electrically conductive, a charge generating layer, a charge transport layer, and an overcoat layer. The charge transport layer comprises a film-forming polymer binder, a trifluoro acetic acid and the first and second charge transport molecules discussed above. The trifluoro acetic acid (TFA) is present in an amount of from about 5 ppm to about 30 ppm or from 10 ppm to 25 ppm. Also disclosed herein is a method of imaging which comprises generating an electrostatic latent image on the imaging member set forth above, developing the latent image and transferring the developed electrostatic image to a suitable substrate.

In a specific embodiment, the charge transport layer comprises a polycarbonate binder of poly(4,4'-isopropylidene diphenyl) carbonate, a first charge transport molecule of N,N'-diphenyl-N,N'-bis(3-methylphenyl)-[1,1'-biphenyl]-4,4'-diamine (m-TBD), a second charge transport molecule of tri-p-tolylamine (TTA), and trifluoro acetic acid in the amount of from about 10 ppm to about 25 ppm. The resulting charge transport layer has a glass transition temperature (Tg) of from about 30° C. to about 65° C.

The flexible imaging member further comprises a protective overcoat layer positioned over the charge transport layer. The formulation of the overcoat layer comprises: (1) a film forming charge transporting polymer, or (2) a polymer blend of two film forming polymers in which one polymer has inherent charge transporting capability, or (3) a film forming polymer having charge transport molecules dispersed therein. The polymer may be either a film-forming thermoplastic or a film forming thermoset plastic polymer. The protective overcoat layer may have a thickness of from about 1 to about 10 micrometers. In specific embodiments, the overcoat layer has a thickness of from about 2 to about 5 micrometers.

In another embodiment of the present disclosure, an image-forming apparatus for forming images on a recording medium is disclosed. The apparatus comprises a flexible electrophotographic imaging member having a charge retentive surface to receive an electrostatic latent image thereon, wherein the imaging member is as described herein. Also included is a development component to apply a developer material to the charge-retentive surface to develop the electrostatic latent image to form a developed image on the charge-retentive surface. Additionally, the apparatus comprises a transfer component for transferring the developed image from the charge-retentive surface to another member or a copy substrate and a fusing member to fuse the developed image to the copy substrate.

Further disclosed are methods of imaging utilizing one or more of the embodiments of an imaging member set forth herein.

These and other non-limiting features or characteristics of the present disclosure will be further described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
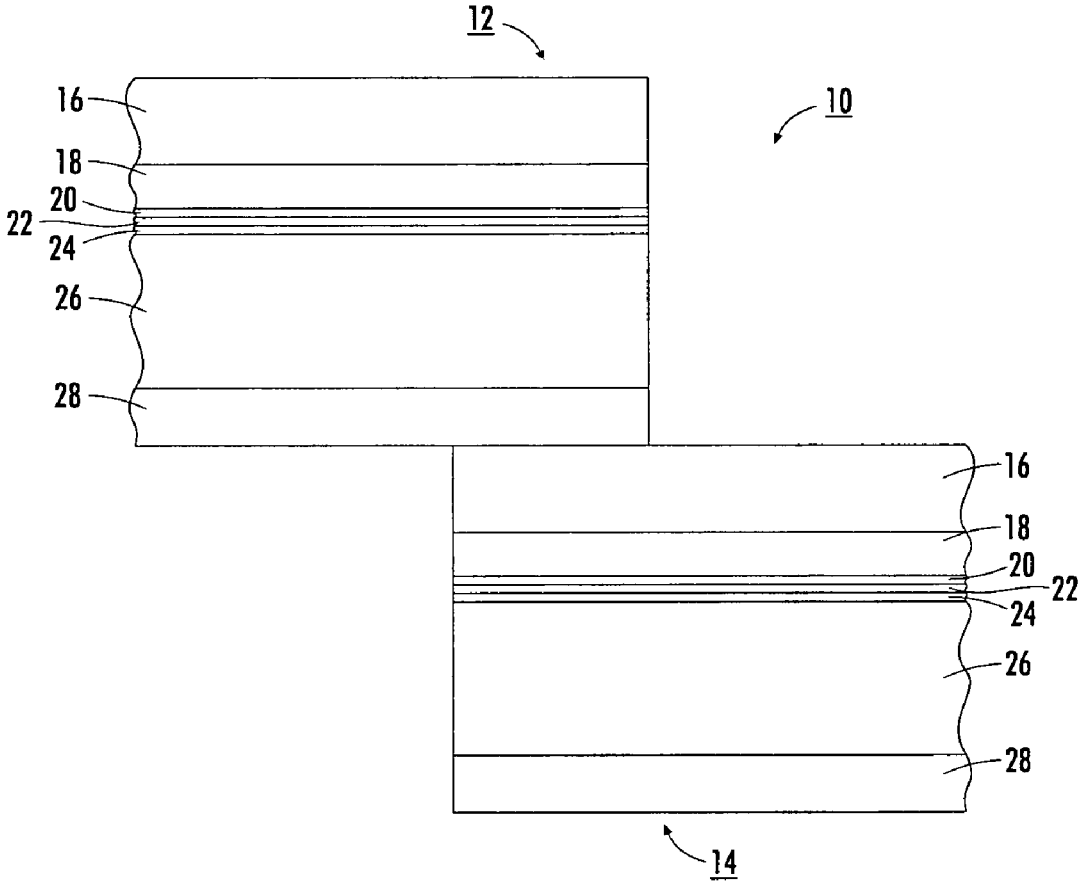
FIG. 1 illustrates a schematic partial cross-sectional view of a conventional multiple layered flexible sheet of electrophotographic imaging material with opposite ends overlapped.

A flexible imaging member which does not require the use of an anti-curl back coating is disclosed herein. The flexible imaging member has a layer comprising two charge transport molecules dispersed in a film-forming polymer binder. The first charge transport molecule is a biphenyl amine, terphenyl diamine, or bis(triarylamine) stilbene. The second charge transport molecule is a bis(triarylamine), tri-p-tolylamine, or triphenylamine. The weight ratio of second charge transport molecule to first charge transport molecule is from about 90:10 to about 66:34. Trifluoro acetic acid is also added to the layer containing the charge transport material.

The exemplary embodiments of this disclosure are more particularly described below with reference to the drawings. Although specific terms are used in the following description for clarity, these terms are intended to refer only to the particular structure of the various embodiments selected for illustration in the drawings and not to define or limit the scope of the disclosure. The same reference numerals are used to identify the same structure in different Figures unless specified otherwise. The structures in the Figures are not drawn according to their relative proportions and the drawings should not be interpreted as limiting the disclosure in size or location.

Referring to FIG. 1, there is illustrated a conventional electrophotographic flexible imaging member 10, used for a negatively charging system, in the form of a sheet having a first end marginal region 12 overlapping a second end marginal region 14 to form an overlap region ready for a seam forming operation into a flexible belt. The flexible imaging member 10 can be utilized within an electrophotographic imaging member device and may be a member having a flexible substrate support layer combined with one or more additional coating layers. At least one of the coating layers comprises a film forming binder.

The flexible imaging member sheet 10 may comprise multiple layers. If the flexible imaging member sheet is a negatively charged photoreceptor device, the flexible imaging member sheet may comprise a charge generating layer sandwiched between an electrically conductive substrate surface layer (coated over the flexible substrate support layer) and a charge transport layer. Alternatively, the flexible member sheet may comprise a charge transport layer sandwiched between a conductive surface layer and a charge generating layer to give a positively charged photoreceptor device.

The layers of the flexible imaging member sheet 10 can comprise numerous coating layers containing materials of suitable mechanical properties. Examples of typical layers are described in U.S. Pat. No. 4,786,570, U.S. Pat. No. 4,937,117 and U.S. Pat. No. 5,021,309, the entire disclosures of which are incorporated herein by reference. The cut sheet of flexible imaging member sheet 10 with overlapping ends shown in FIG. 1, including the two end marginal regions 12 and 14, comprises from top to bottom a charge transport layer 16, a charge generating layer 18, an interface layer 20, a blocking layer 22, an electrically conductive substrate surface layer 24, a flexible supporting substrate layer 26, and an anti-curl back coating layer 28 which maintains imaging member flatness.

Figure 2:
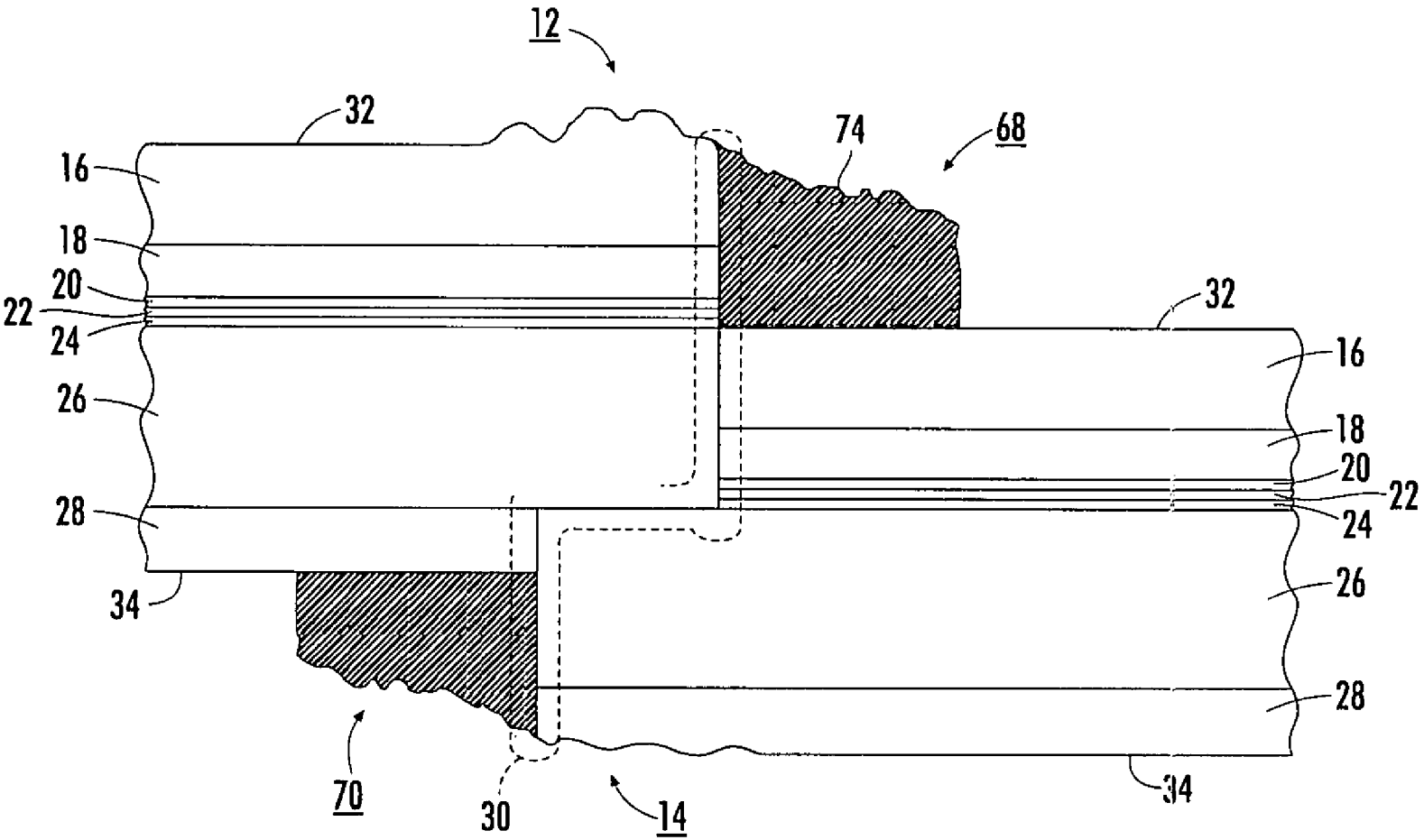
FIG. 2 shows a schematic partial cross-sectional view of a multiple layered seamed flexible electrophotographic imaging belt derived from the sheet illustrated in FIG. 1 after ultrasonic seam welding.

The overlapping end marginal regions 12 and 14 can be joined by different means including ultrasonic welding, gluing, taping, stapling, and pressure and heat fusing to form a continuous imaging member seamed belt, sleeve, or cylinder. However, due to considerations such as ease of belt fabrication, short operation cycle time, and mechanical strength of the fabricated joint, the ultrasonic welding process is usually used to join the overlapping end marginal regions 12 and 14 of flexible imaging member sheet 10 into a seam 30 in the overlapping region, as illustrated in FIG. 2, to form a seamed flexible electrophotographic imaging member belt. As shown in FIG. 2, the location of seam 30 is indicated by an encircling dotted line; the seam 30 comprises two vertical portions joined by a horizontal portion. The flexible electrophotographic imaging member sheet 10 is thus transformed from a cut sheet of imaging member material having desirable dimensions as illustrated in FIG. 1 into a continuous flexible electrophotographic imaging member seamed belt as pictorially represented in FIG. 2. The flexible imaging member seamed belt has a first major exterior or top surface 32 and a second major exterior or bottom surface 34 on the opposite side. The seam 30 joins the two overlapping ends of flexible imaging member sheet 10 so that the bottom surface 34 (generally including at least one layer immediately above) at and/or near the first end marginal region 12 is integral with the top surface 32 (generally including at least one layer immediately below) at and/or near the second end marginal region 14.

When an ultrasonic welding process is employed to transform the sheet of flexible electrophotographic imaging member material into an imaging member seamed belt, the seam of the belt is created by the high frequency mechanical pounding action of a welding horn over the overlapped opposite end regions of the imaging member sheet to cause material fusion. In the ultrasonic seam welding process, ultrasonic energy generated by the welding horn action, in the form of heat is applied to the overlap region to melt layers such as the charge transport layer 16, charge generating layer 18, interface layer 20, blocking layer 22, conductive layer 24, a small part of the substrate support layer 26, and the anti-curl back coating 28 as well. Therefore, direct material fusing at the interface between the contacting surfaces of the two overlapping ends of the substrate support layer provides best adhesion bonding to give highest seam rupture strength.

Figure 3:
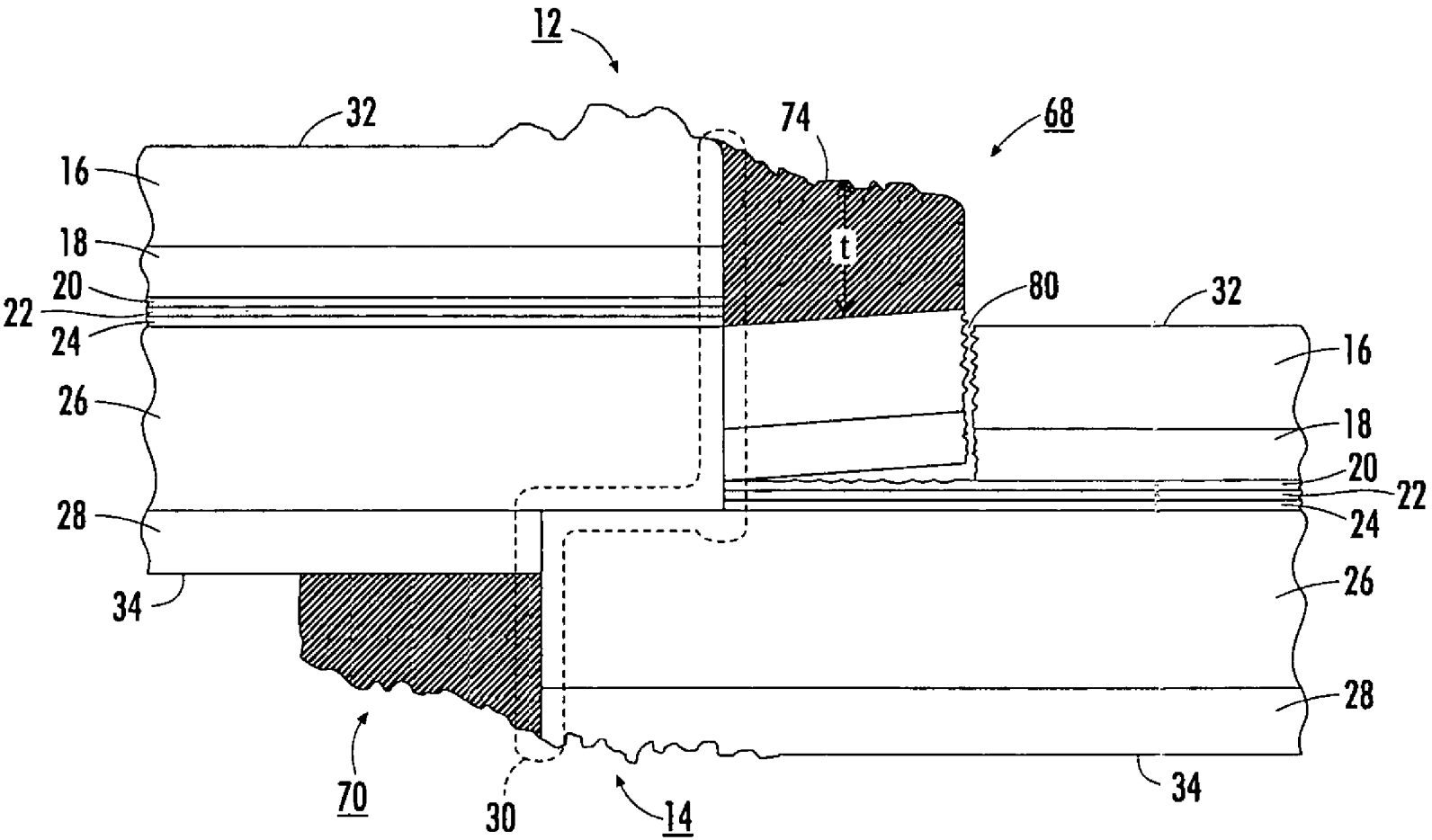
FIG. 3 illustrates a schematic partial cross-sectional view of a multiple layered seamed flexible electrophotographic imaging belt which has failed due to fatigue induced seam cracking and delamination.
Figure 4:
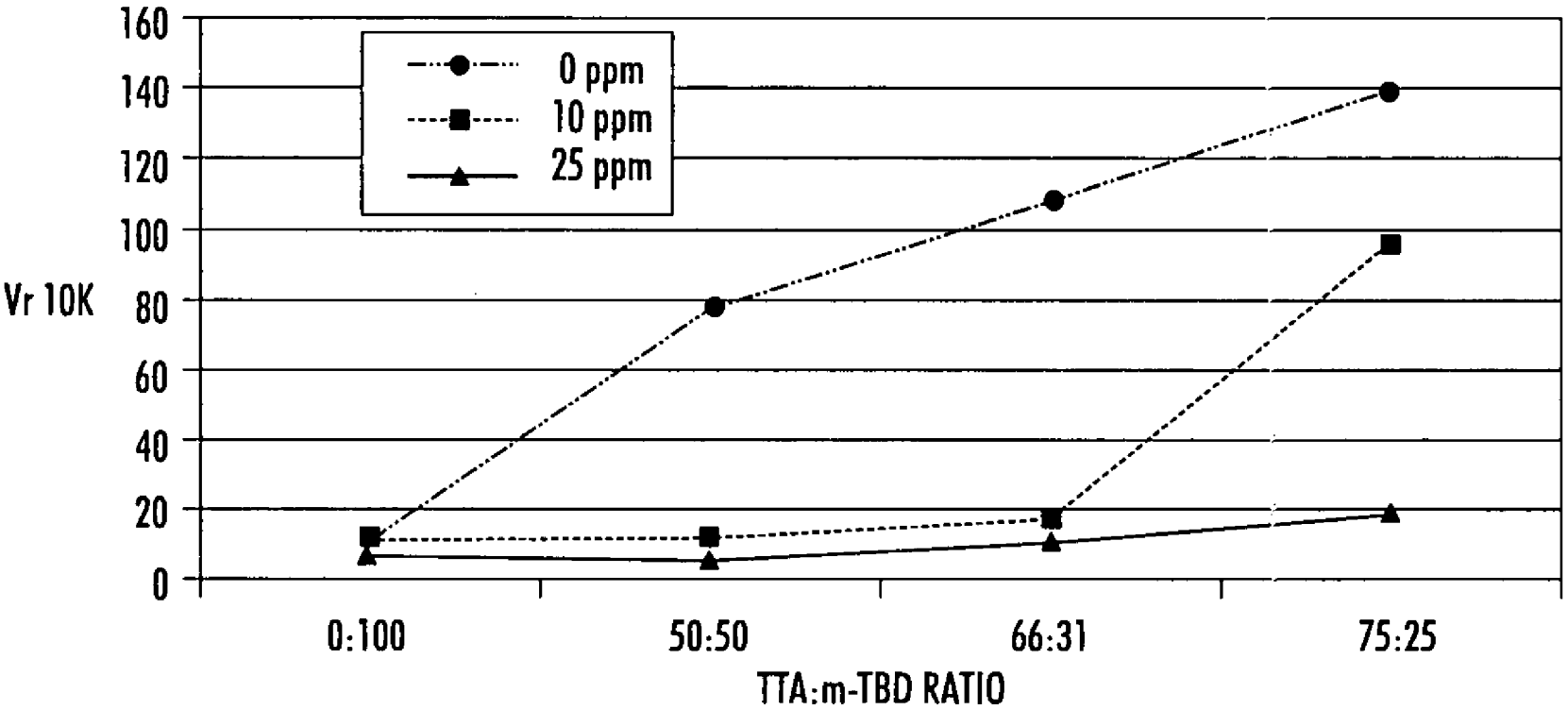
FIG. 4 is a graph illustrating the effect of trifluoro-acetic acid doping in the charge transport layer, comprising tri-p-tolylamine (TTA) and m-TBD transport molecules blend, on the 10,000 cycle residual voltage of resulting imaging member.
Figure 5:
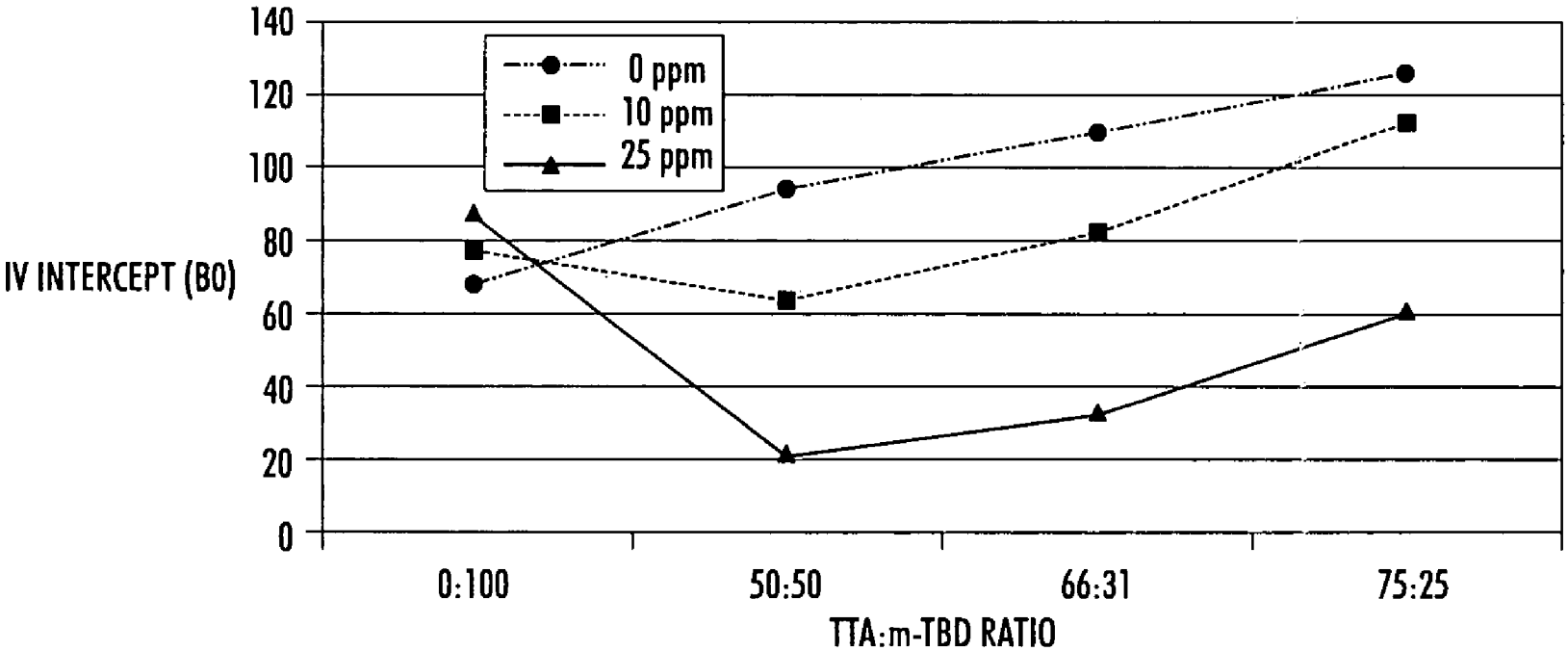
FIG. 5 is a graph illustrating the effect of trifluoro-acetic acid doping in the charge transport layer, comprising tri-p-tolylamine (TTA) and m-TBD transport molecules blend, on the depletion potential of resulting imaging member.
Figure 6:
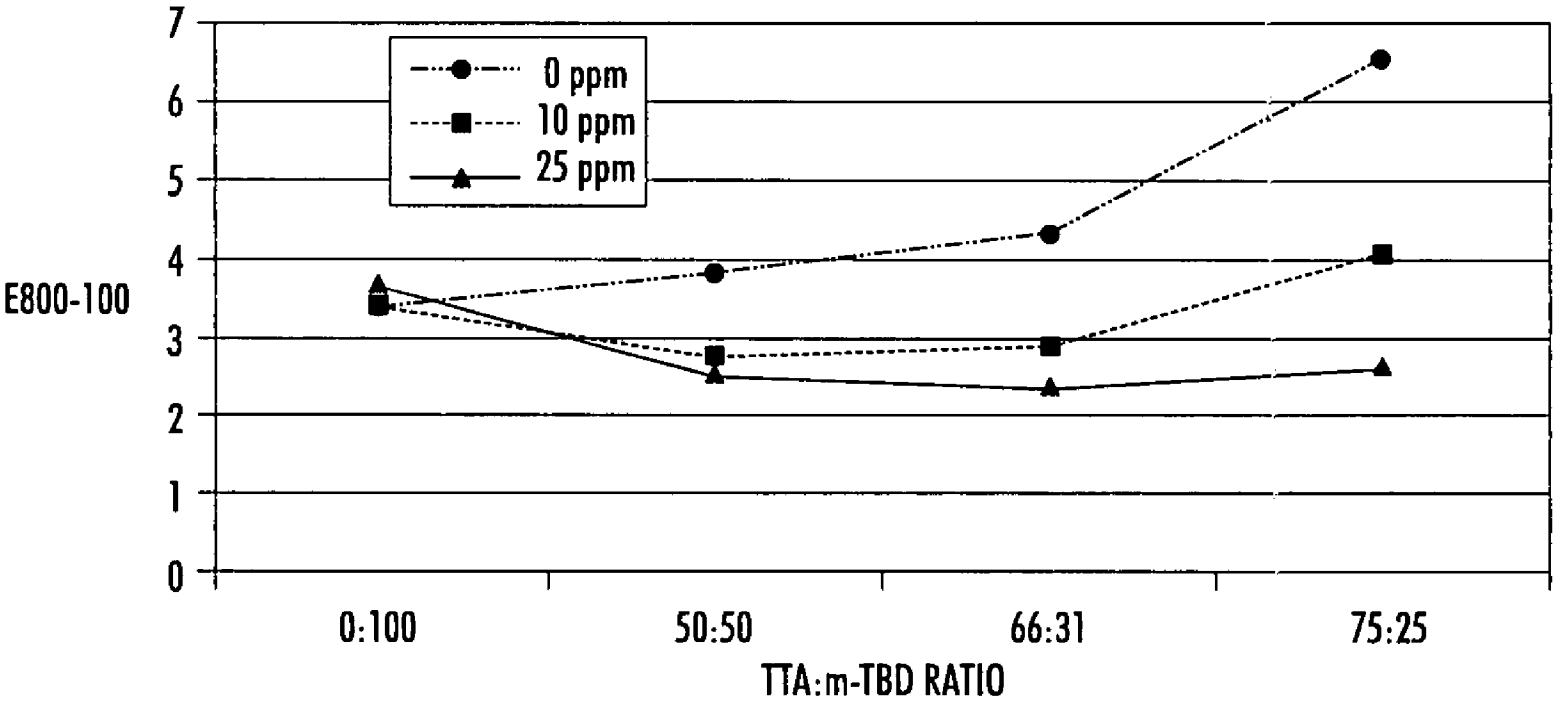
FIG. 6 is a graph illustrating the effect of trifluoro-acetic acid doping in the charge transport layer, comprising tri-p-tolylamine (TTA) and m-TBD transport molecules blend, on the exposure radiation energy (erg/cm$^2$) required to discharge the surface potential from 800 volts to 100 volts of the resulting imaging member.
Figure 7:
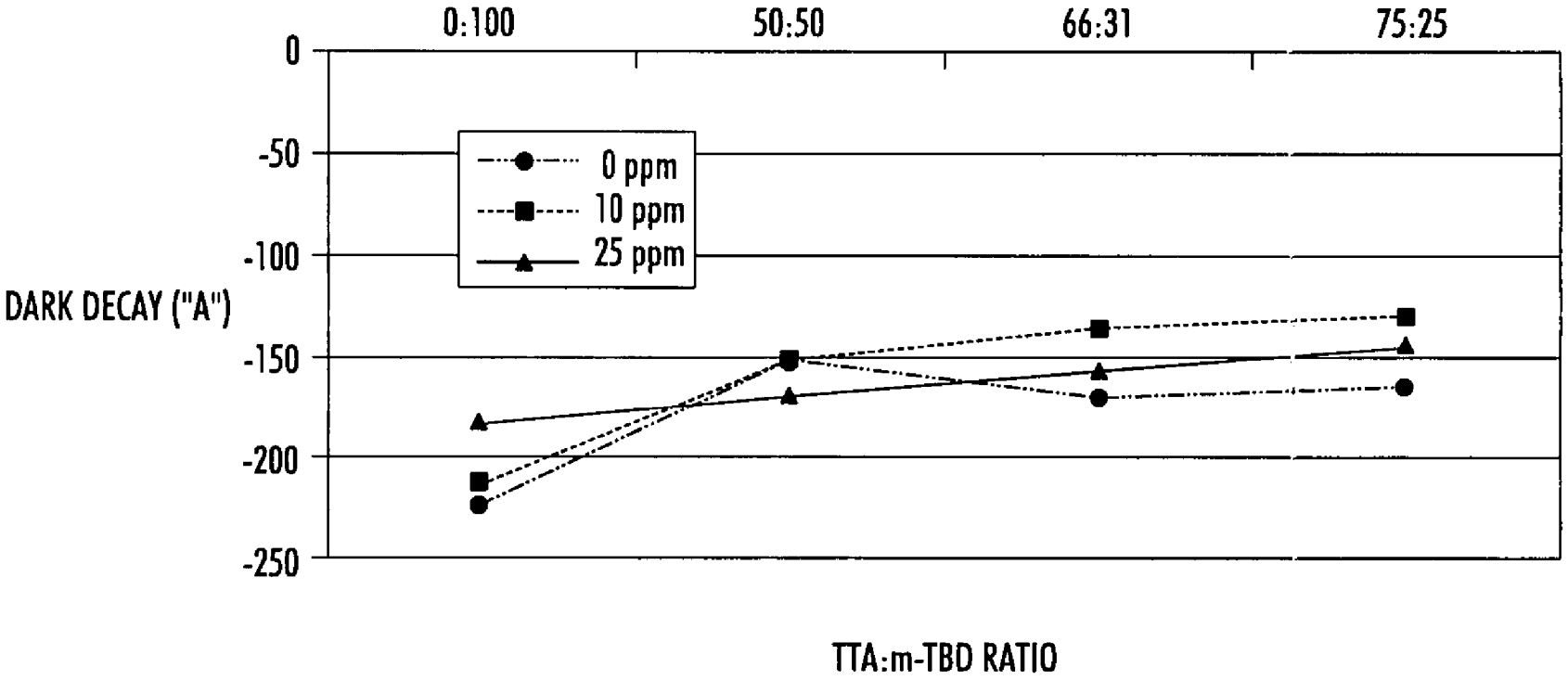
FIG. 7 is a graph illustrating the effect of trifluoro-acetic acid doping in the charge transport layer, comprising tri-p-tolylamine (TTA) and m-TBD transport molecules blend, on the dark decay potential of resulting imaging member.

Upon completion of welding of the overlapping region of the imaging member sheet into a seam 30 with the ultrasonic seam welding techniques, the overlapping ends are converted into an abutting region shown in FIGS. 2 and 3. Within the abutting region, the end marginal regions 12 and 14 are joined by the seam 30 such that they abut one another. The welded seam 30 contains top and bottom splashings 68 and 70 as illustrated in FIGS. 2 and 3; the splashings are formed by the process of joining the end marginal regions together. Molten mass of materials, consisting of all of the imaging member layers at inside domain of the overlapping ends, are necessarily ejected to either side of the overlap region as opposite ends am fused together; this causes the formation of two splashings 68 and 70 on either side of the welded seam 30. The top splashing 68 is located above the overlapping end marginal region 14 abutting the top surface 32 and adjacent to and abutting the overlapping end marginal region 12. The bottom splashing 70 is located below the overlapping end marginal region 12 abutting bottom surface 34 and adjacent to and abutting the overlapping end marginal region 14. A typical seam splashing has a height or thickness t of about 80 micrometers above the bet surface. The seam splashings 66 and 70 may extend beyond the two imaging member belt edges or sides in the overlap region of the welded flexible imaging member seamed belt, they are therefore usually undesirable for many machines, such as electrophotographic copiers, duplicators and copiers, that require precise edge positioning of a flexible member seamed belt during machine operation. The bottom splashing 70 also interacts physically with the belt support rollers and the backer bars of the belt module it travels over, affecting the imaging member belt's delicate motion/transporting speed. The top splashing 68 with a rough surface morphology 74 can mechanically interfere with the cleaning blade's sliding action by nicking the blade and exacerbating blade wear, causing the cleaning blade's premature loss of cleaning efficiency during electrophotographic imaging member belt machine function. For these reasons, the splashing extensions are usually removed or notched out from the two bet edges with a puncher.

Large tension stresses will develop in the vicinity adjacent to the seam 30 due to the excessively large seam splashing size 68 and its material and geometrical discontinuity thereof. The detrimental effect of stress concentration compounded by the repeating cleaning blade striking/impact on the seam during imaging member belt cycling promotes the early development of a seam cracking/delamination failure site 80 as shown in FIG. 3. The failure site 80 acts as a deposit site for toner, paper fibers, dirt, debris and other unwanted materials during electrophotographic imaging and cleaning processes of the flexible imaging member seamed belt. For example, during the cleaning process, a cleaning instrument, such as a cleaning blade, will repeatedly pass over the failure site 80. As the failure site 80 becomes filled with debris, the cleaning instrument may dislodge at least a portion of this highly concentrated level of debris. The amount of debris, however, is beyond the removal capacity of the cleaning instrument. Instead, portions of the highly concentrated debris are deposited onto the surface of the seamed belt. In effect, the cleaning instrument spreads the debris across the surface of the flexible imaging member seamed belt instead of removing the debris therefrom.

In addition to seam failure and debris spreading, the portion of the flexible imaging member seamed belt above the failure site 80 can act as a flap which moves upwardly. This flap can become an obstacle to the cleaning instrument as it travels across the surface of the seamed belt. When the cleaning instrument strikes the flap, great force is exerted on the cleaning instrument which can lead to damage, e.g., excessive wear, nicking, and tearing of the cleaning blade.

Besides damaging the cleaning blade, the striking of the flap by the cleaning instrument can cause unwanted vibration in the flexible imaging member seamed belt. This unwanted vibration adversely affects copy/print quality because imaging occurs on one part of the seamed belt simultaneously with the cleaning of another part of the seamed belt.

When the flexible imaging member seamed belt bends over the exterior surfaces of the rollers of a belt module within an electrophotographic imaging apparatus, the bottom surface 34 of the flexible imaging member seamed belt is compressed while the top surface 32 is stretched under tension. Compression stresses, such as those at the bottom belt surface 34, rarely cause seam failure. Tension stresses, such as that induced at the top belt surface 32, however, are a more serious problem. Tension stress is the cause of charge transport layer cracking; additionally, such cracks may propagate throughout the other layers of the imaging member. These fatigue-induced cracks manifest themselves into copy printout defects. Consequently, the usefulness and service life of a flexible imaging member seamed belt is shortened from about 105,000 belt cycles for an imaging member belt of the present disclosure to about 47,000 belt cycles for a control imaging belt member when dynamically tested in an imaging machine utilizing a belt support module equipped with two 19 millimeter diameter rollers.

Imaging members of the present disclosure may comprise a flexible supporting substrate 26, a conductive layer 24, an optional charge blocking layer 22, an optional adhesive layer 20, a charge generating layer 18, a charge transport layer 16, and an overcoat layer. However, the imaging member of the present disclosure does not contain an anti-curl back coating 28 of conventional prior art imaging member 10 as shown in FIG. 1. Each layer of the imaging member is described below.

The substrate may be opaque or substantially transparent and may comprise numerous suitable materials having the required mechanical properties. When the substrate material is an electrically non-conductive material, the substrate may further be provided with an electrically conductive layer; i.e. the electrically conductive layer may be optional. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, and the like. The electrically insulating or conductive substrate may be flexible, semi-rigid, or rigid, and may have any number of different configurations such as, for example, a sheet, a scroll, an endless flexible belt, a cylinder, and the like. The substrate may be in the form of an endless flexible belt which comprises a commercially available biaxially oriented polyester known as MYLAR™, MELINEX™, and KALADEX® available from E. I. du Pont de Nemours & Co.

The thickness of the substrate layer depends on numerous factors, including mechanical performance and economic considerations. The thickness of this layer, especially for a flexible imaging member belt, may range from about 50 micrometers to about 200 micrometers. The surface of the substrate layer is preferably cleaned prior to coating to promote greater adhesion of the deposited coating composition. Cleaning may be effected by, for example, exposing the surface of the substrate layer to plasma discharge, ion bombardment, and the like methods. However, in specific embodiments, the substrate has a thickness of from about 50 micrometers to about 125 micrometers, based on the considerations of optimum light energy transmission for effective back erase, adequate substrate flexibility, and cost impact. A substrate of polyethylene naphthalate (PEN) is also effectively used in embodiments of the present disclosure.

The conductive layer on the flexible substrate may vary in thickness over substantially wide ranges depending on the optical transparency and degree of flexibility desired for the electrophotographic member. Accordingly, for a flexible photoresponsive imaging device, the thickness of the conductive layer may be from about 20 angstrom units to about 750 angstrom units, and more preferably from about 100 Angstrom units to about 200 angstrom units for an optimum combination of electrical conductivity, flexibility and light transmission. The electrically conductive substrate surface layer may be an electrically conductive metal layer formed, for example, on the substrate by different coating technique, such as a vacuum depositing technique. Typical metals include aluminum, zirconium, niobium, tantalum, vanadium and hafnium, titanium, nickel, stainless steel, chromium, tungsten, molybdenum, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. In embodiments, for rear erase exposure, an electrically conductive substrate surface layer light transparency of at least about 15% is desirable. The electrically conductive substrate surface layer need not be limited to metals. Other examples of electrically conductive substrate surface layers may be combinations of materials such as conductive indium tin oxide as a transparent layer for light having a wavelength from about 4000 Angstroms to about 7000 Angstroms or a transparent copper iodide (CuI) or a conductive carbon black dispersed in a plastic binder as an opaque conductive layer.

An optional charge blocking layer may be applied to the electrically conductive substrate surface layer prior to or subsequent to application of the anti-curl backing layer to the opposite side of the substrate. Generally, electron blocking layers for positively charged photoreceptors allow holes from the imaging surface of the photoreceptor to migrate toward the conductive layer. Any blocking layer capable of forming an electronic barrier to holes between the adjacent photoconductive layer and the underlying conductive layer may be utilized. The blocking layer may be nitrogen containing siloxanes or nitrogen containing titanium compounds as disclosed, for example, in U.S. Pat. No. 4,338,387, U.S. Pat. No. 4,286,033 and U.S. Pat. No. 4,291,110, the disclosures of which are incorporated herein by reference. In embodiments, a preferred blocking layer comprises a reaction product between a hydrolyzed silane and the oxidized surface of a metal ground plane layer. The blocking layer may be applied by different techniques such as spraying, dip coating, draw bar coating, gravure coating, silk screening, air knife coating, reverse roll coating, vacuum deposition, chemical treatment and the like. For convenience in obtaining thin layers, the blocking layers in embodiments are preferably applied in the form of a dilute solution, with the solvent being removed after deposition of the coating by techniques such as by vacuum, heating and the like. The blocking layer should be continuous and have a thickness of less than about 0.2 micrometer. A greater thickness may lead to undesirably high residual voltage.

An optional adhesive layer may be applied to the hole blocking layer. Typical adhesive layer materials include, for example, polyesters, DUPONT 49,000 (available from E. I. Du Pont de Nemours and Company), VITEL PE100 (available from Goodyear Tire & Rubber), and polyurethanes. In embodiments, satisfactory results may be achieved with an adhesive layer thickness from about 0.05 micrometer (500 Angstroms) to about 0.3 micrometer (3,000 Angstroms). Techniques for applying an adhesive layer coating mixture to the charge blocking layer include spraying, dip coating, roll coating, wire wound rod coating, gravure coating, bird applicator coating, and the like. Drying of the deposited coating may be effected by techniques such as oven drying, infrared radiation drying, air drying and the like.

A photogenerating layer or charge generating layer may be applied to the adhesive blocking layer which can then be overcoated with a contiguous charge transport layer as described hereinafter. Examples of photogenerating layers include inorganic photoconductive particles such as amorphous selenium, trigonal selenium, and selenium alloys comprising selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, the disclosure of which is incorporated herein by reference, metal phthalocyanines such as vanadyl phthalocyanine and copper phthalocyanine, dibromoanthanthrone, squarylium, quinacridones available from DuPont under the tradename MONASTRAL RED, MONASTRAL VIOLET, and MONASTRAL RED Y, VAT ORANGE 1 and VAT ORANGE 3 (tradenames for dibromo anthanthrone pigments), benzimidazole perylene, substituted 2,4-diamino-triazines disclosed in U.S. Pat. No. 3,442,781, the disclosure of which is incorporated herein by reference, polynuclear aromatic quinones available from Allied Chemical Corporation under the tradenames INDOFAST DOUBLE SCARLET, INDOFAST VIOLET LAKE B, INDOFAST BRILLIANT SCARLET, and INDOFAST ORANGE, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated by reference. Other photogenerating materials known in the art may also be utilized. Charge generating binder layers comprising particles or layers of a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof may be utilized because of their sensitivity to white light. Vanadyl phthalocyanine, metal-free phthalocyanine and tellurium alloys may also be incorporated because these materials provide sensitivity to infrared light.

A polymeric film forming binder material may be employed as the matrix in the photogenerating binder layer. Typical polymeric film forming materials include those described, for example, in U.S. Pat. No. 3,121,006, the disclosure of which is incorporated herein by reference. Organic polymeric film forming binders include thermoplastic and thermosetting resins including polystyrene-co-4 vinyl pyridine, polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloridevinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in amounts, generally, of from about 5% by volume to about 90% by volume and is dispersed in from about 10% by volume to about 95% by volume of resinous binder, and in embodiments preferably from about 20% by volume to about 30% by volume of photogenerating pigment is dispersed in about 70% by volume to about 80% by volume of resinous binder composition. In one embodiment, about 8% by volume of photogenerating pigment is dispersed in about 92% by volume of resinous binder composition.

The photogenerating layer containing photoconductive compositions and/or pigments and the resinous binder material generally ranges in thickness of from about 0.1 micrometers to about 5 micrometers, and in embodiments has a thickness of from about 0.3 micrometers to about 3 micrometers. The photogenerating layer thickness is related to binder content. Higher binder content compositions generally require thicker layers for photogeneration.

Numerous techniques may be utilized to mix and thereafter apply the photogenerating layer coating mixture; these techniques include spraying, dip coating, roll coating, or wire wound rod coating. Drying of the deposited coating may be effected by different techniques such as oven drying, infra red radiation drying, air drying and the like.

The charge transport layer of the present disclosure comprises two charge transport molecules and trifluoro acetic acid (TFA) dispersed in a film-forming polymer resin binder. The charge transport molecules may be added to polymeric materials which are incapable of supporting the injection of photogenerated holes from the charge generating layer and incapable of allowing the transport of these holes. This converts the electrically inactive polymeric material to a material capable of supporting the injection of photogenerated holes from the charge generating layer and capable of allowing the transport of these holes through the active layer in order to discharge the surface charge on the active layer. The charge transport layer of the present disclosure has a glass transition temperature (Tg) of from about 30° C. to about 65° C.; in specific embodiments it has a Tg of from about 35° C. to about 45° C. and in other specific embodiments it has a Tg of from about 39° C. to about 45° C. The difference in thermal contraction coefficient between the charge transport layer and the substrate is in the amount of from about $+2\times10^{-5}/°$ C. to about $-0.5\times10^{-5}/°$ C. in the temperature range between the Tg of the charge transport layer and 25° C. (or ambient room temperature).

The first charge transport molecule is a biphenyl diamine, a terphenyl diamine, or a bis(triarylamine) stilbene. The biphenyl diamine is represented by Formula (I) below:

Formula (I)

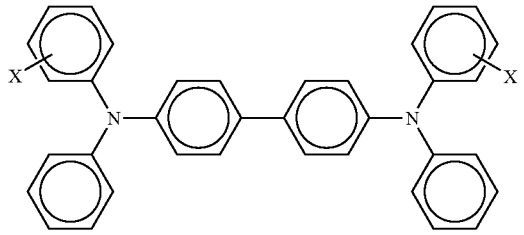

wherein X is selected from the group consisting of alkyl, hydroxyl, and halogen. Such diamines are disclosed in U.S. Pat. No. 4,265,990; U.S. Pat. No. 4,233,384; U.S. Pat. No. 4,306,008; U.S. Pat. No. 4,299,897; and U.S. Pat. No. 4,439,507; these disclosures are herein incorporated in their entirety for reference.

The terphenyl diamine is represented by Formula (II) below:

Formula (II)

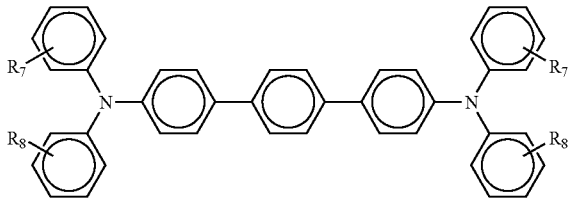

wherein $R_7$ and $R_8$ are independently selected from alkyl, hydroxyl, and halogen. In a specific embodiment, $R_7$ and $R_8$ are methyl groups attached to the ortho position of each phenyl ring.

The bis(triarylamine) stilbene is represented by Formula (III) below:

Formula (III)

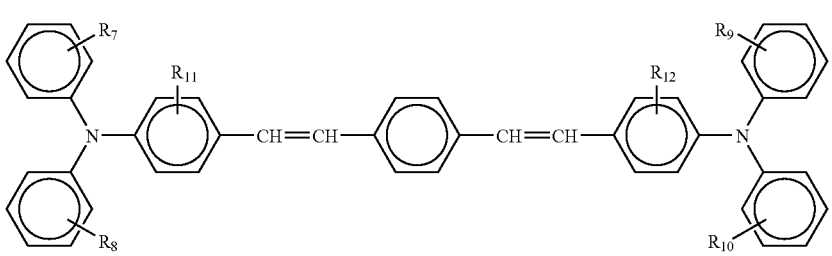

wherein $R_7$ through $R_{12}$ are independently selected from the group consisting of hydrogen, halogen, alkyl having 1 to 3 carbon atoms, aryl having 6 to 10 carbon atoms, and cycloalkyl having 3 to 18 carbon atoms.

Examples of diamines suitable as the first charge transport molecule include, but are not limited to, N,N,N',N'-tetra(o-methylphenyl)-[p-terphenyl]-4,4'-diamine; N,N'-bis(4-methylphenyl)-N,N'-bis[4-(1-butyl)-phenyl]-[p-terphenyl]-4,4'-diamine; N,N'-bis(3-methylphenyl)-N,N'-bis[4-(1-butyl)-phenyl]-[p-terphenyl]-4,4'-diamine; N,N'-bis(4-t-butylphenyl)-N,N'-bis[4-(1-butyl)-phenyl]-[p-terphenyl]-4,4'-diamine; N,N,N',N'-tetra[4-(1-butyl)-phenyl]-[p-terphenyl]-4,4'-diamine; N,N,N',N'-tetra[4-t-butyl-phenyl]-[p-terphenyl]-4,4'-diamine; N,N'-diphenyl-N,N'-bis(4-methylphenyl)-1,1'-biphenyl-4,4'-diamine; N,N'-bis(4-methylphenyl)-N,N'-bis(4-ethylphenyl)-1,1'-(3,3'-dimethylbiphenyl)-4,4'-diamine; N,N'-diphenyl-N,N'-bis(3-methylphenyl)-[1,1'-biphenyl]-4,4'-diamine (m-TBD); N,N'-diphenyl-N,N'-bis(alkylphenyl)-1,1'-biphenyl-4,4'-diamine and N,N'-diphenyl-N,N'-bis(chlorophenyl)-1,1'-biphenyl-4,4'-diamine. Other suitable diamines include N,N'-bis(alkyl)-N,N'-bis(phenyl)-[1,1'-biphenyl]-4,4'-diamine. In specific embodiments, the diamine is m-TBD or N,N,N',N'-tetra(o-methylphenyl)-[p-terphenyl]-4,4'-diamine.

The second charge transport molecule is selected from the group consisting of a bis(triarylamine), 1,1-bis(4-di-n-tolylaminophenyl)cyclohexane, tri-p-tolylamine, and triphenylamine as shown in Formulas (IV) to (VII). The bis(triarylamine) is represented by Formula (IV) shown below:

Formula (IV)

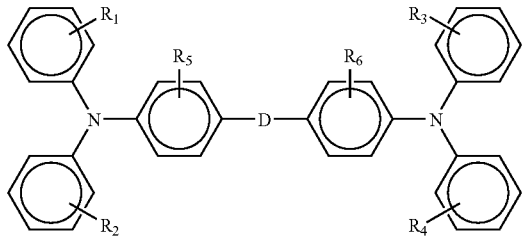

wherein $R_1$ through $R_6$ are independently selected from alkyl having 1 to 3 carbon atoms and hydrogen; and wherein D is a divalent linkage selected from —O—, saturated or unsaturated alkyl having 1 to 8 carbon atoms, substituted alkyl having 1 to 8 carbon atoms, and cycloalkyl having 1 to 6 carbon atoms, wherein D is not phenyl.

The bis(triarylamine) of Formula (IV) will always be different from the biphenyl amine of Formula (I) because it contains a divalent linkage D between the two phenyl rings. The bis(triarylamine) of Formula (IV) will always be different from the terphenyl amine of Formula (II) because D cannot be phenyl.

In a specific embodiment, D is cyclohexane; $R_1$ through $R_4$ are methyl in the para position; and $R_5$ and $R_6$ are hydrogen. In this embodiment, the bis(triarylamine) of Formula (IV) is 1,1-bis(4-di-p-tolylaminophenyl) cyclohexane represented by Formula (V) below:

Formula (V)

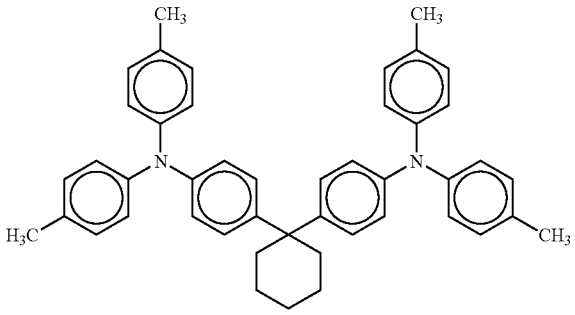

Tri-p-tolylamine is shown in Formula (VI) and triphenylamine is shown in Formula (VII) below:

Formula (VI)

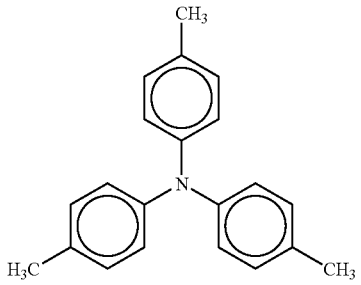

Formula (VII)

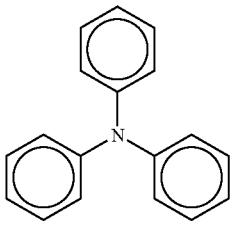

The combination of the given first and second charge transport molecules is critical. The first charge transport molecules have better photoelectrical properties than the second charge transport molecules. However, the first charge transport molecules also cause the charge transport layer to curl upward, whereas the second charge transport molecules do not. The second charge transport molecules reduce the glass transition temperature (Tg) of the charge transport layer more quickly on a weight basis than the first charge transport molecules. This is undesirable because a minimum Tg of at least 5° C. above a xerographic machine operational temperature needs to be maintained or else the charge transport layer plasticizes and becomes unusable. Although the combination of first and second charge transport molecules is a critical factor to balancing the Tg of the charge transport layer and affect the outcome of imaging member flatness, the blending of these two types of charge transport molecules also minimizes the thermal contraction coefficient mismatch between the charge transport layer and the substrate support to reduce the internal strain from the charge transport layer of this disclosure. Therefore, the effect of Tg reduction complemented by minimizing the thermal contraction mismatch produces a synergy to render the resulting imaging member with flatness without the need of an anti-curl back coating.

It has been found that as the weight ratio of second charge transport molecule to first charge transport molecule (second:first) increases in a charge transport layer, the degree of upward curling decreases and the Tg decreases as well. For example, when the charge transport layer contains only m-TBD, the photoreceptor will curl into a tube having a diameter of curvature of 1.5 inches. However, when the second:first ratio is 50:50 by weight, the tube has a diameter of curvature of 6.25 inches. When the second:first ratio is 66:34 by weight, the photoreceptor exhibits no upward curling and becomes flat. When the second:first ratio is 0:100 by weight (or no TTA, but m-TBD only), the Tg is 85° C.; when the second:first ratio is 66:34 by weight, the Tg is 46° C. In specific embodiments, the second:first weight ratio is from about 90:10 to about 55:45. In other specific embodiments, the second:first weight ratio is from about 90:10 to about 60:40. In more specific embodiments, the second:first weight ratio is from about 90:10 to about 66:34. The second:first weight ratio is critical to obtaining a photoreceptor which exhibits no upward curling and to obtaining a charge transport layer with a given Tg.

In specific embodiments, the weight ratio of second:first is selected so that the Tg is between from about 35° C. to about 45° C. This ensures that the resulting charge transport layer is free of built-in internal strain. Because the charge transport layer of the present disclosure has no internal strain, it eliminates charge transport layer cracking due to flexing and/or normal service conditions.

Trifluoro acetic acid (TFA) is added to the charge transport layer to maintain the imaging member's photoelectrical integrity in an amount of from about 5 ppm to about 30 ppm; in further specific embodiments, TFA is added in an amount of from about 10 ppm to about 25 ppm.

An inactive thermoplastic resin binder soluble in methylene chloride or other solvent may be employed to prepare the coating solution and form the thermoplastic polymer matrix of the charge transport layer of the imaging member. Typical inactive resin binders soluble in methylene chloride include polycarbonate resin, polyvinylcarbazole, polyester, polyarylate, polyacrylate, polyether, polysulfone, polystyrene, polyamide, and the like. Molecular weights can vary from about 20,000 to about 150,000. The film-forming binder is usually a polycarbonate resin.

In embodiments, the film-forming polycarbonate binder used in the charge transport layer is a poly(4,4'-isopropylidene diphenyl) carbonate (available from Bayer as MAKROLON) represented by Formula (VIII) below, Formula (VIII)

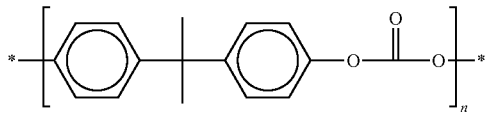

or a poly(4,4'-diphenyl-1,1'-cyclohexane) carbonate (PC-z 200, available from Mitsubishi Gas Chemical Corporation) represented by Formula (IX) below, Formula (IX)

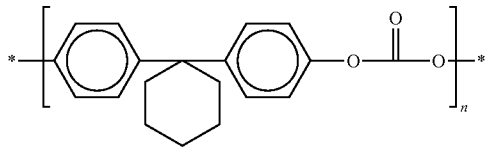

or a polyphthalate carbonate (available from General Electric Company as LEXAN PPC 4701) represented by Formula (X) below:

Formula (X)

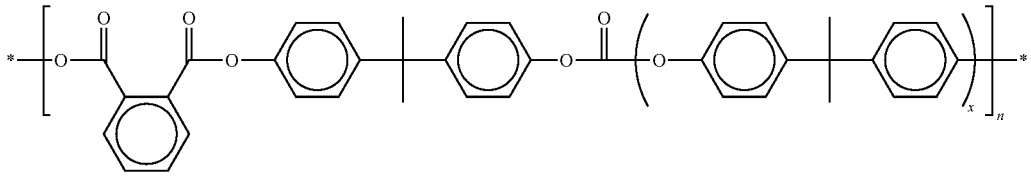

wherein x is an integer from about 1 to about 10; n is the degree of copolymerization, and n is a number of from about 50 to about 300. These polycarbonates are preferred because they are highly miscible with the selected charge transport molecules in a large range of weight ratios. They form a solid solution charge transport layer having good flexibility and mechanical strength suitable for a flexible belt application.

Polycarbonate resins having a weight average molecular weight Mw, of from about 20,000 to about 250,000 are suitable for use, and in embodiments from about 50,000 to about 120,000, may be used based on the ease of forming a coating solution having proper viscosity for application and on the mechanical strength of the resulting charge transport layer. The electrically inactive resin material may include poly(4,4'-isopropylidene-diphenylene carbonate) with a weight average molecular weight ($M_w$) of from about 35,000 to about 40,000, available as LEXAN 145 from General Electric Company; poly(4,4'-isopropylidene-diphenylene carbonate) with a molecular weight of from about 40,000 to about 45,000, available as LEXAN 141 from the General Electric Company; and a polycarbonate resin having a molecular weight of from about 20,000 to about 50,000 available as MERLON from Mobay Chemical Company. In specific embodiments, MAKROLON, available from Mobay Chemical Company, and having a molecular weight of from about 130,000 to about 200,000, is used. Methylene chloride is used as a solvent in the charge transport layer coating mixture for its low boiling point and the ability to dissolve charge transport layer coating mixture components to form a charge transport layer coating solution.

In embodiments, the charge transport layer of the present disclosure comprises from about 25 weight percent (wt %) to about 75 wt % of all charge transport molecules and from about 75% to about 25% by weight of the film-forming polymeric binder resin, both by total weight of the charge transport layer. In specific embodiments, the charge transport layer comprises from about 45 wt % to about 55 wt % of all charge transport molecules and from about 55 wt % to about 45 wt % of the film-forming polymeric binder resin.

Different techniques may be utilized to mix and thereafter apply the charge transport layer coating mixture to the charge generating layer. Typical application techniques include spraying, dip coating, roll coating, wire wound rod coating, and the like. Drying of the deposited coating may be effected by different techniques such as oven drying, infra red radiation drying, air drying and the like.

Generally, the thickness of the charge transport layer is from about 10 to about 50 micrometers, but thicknesses outside this range can also be used. In general, the ratio of the thickness of the hole transport layer to the charge generating layer is in embodiments from about 2:1 to 200:1 and in some instances from about 2:1 to about 400:1.

The imaging member further comprises a protective overcoat layer to protect the charge transport layer against abrasion, scratching, and VOC attack. The overcoat layer is from about 1 to about 10 micrometers in thickness, and in specific embodiments a thickness of from about 2 to about 6 micrometers gives optimum mechanical/photoelectrical function. The overcoat comprises a thermoplastic film forming polymer and a small quantity of charge transport molecules. The thermoplastic film forming polymer used to form the overcoat layer is a polymer selected, for example, from the group consisting of polycarbonate, polystyrene, polyether sulfone, polysulfone, polyamide, polyvinyl chloride, and the like.

In specific embodiments, the overcoat layer comprises polycarbonate. Commercially available polycarbonates which may be useful herein include MAKROLON®, such as MAKROLON® 5705, 5900, LUPILON® Z-800, and the like. In embodiments, the polymer is a relatively high molecular weight polymer having molecular weight of from about 100,000 to about 250,000. The polymer is present in the overcoat layer in an amount of from about 90 to about 99 percent, or from about 95 to about 97 percent by weight of the dried overcoat layer.

In embodiments, the charge transport molecule is present in the overcoat in amounts of from about 1 to about 10 percent, or from about 3 to about 5 percent, by weight, based on the weight of the dried overcoat layer. The charge transport molecule in the overcoat layer can be the same as or different from that used in the charge transport layer. Examples of suitable charge transport molecules for the overcoat layer include, but are not limited to, triphenylmethane; bis(4-diethylamino-2-methylphenyl) phenylmethane; stilbene; hydrazone; tritolylamine; enamine phenanthrene diamine; 4',4"-bis(diethylamino)-2',2"-dimethyltriphenylmethane; N,N'-bis(4-methylphenyl)-N,N'-bis[4-(1-butyl)-phenyl]-[p-terphenyl]-4,4"-diamine; N,N'-bis(3-methylphenyl)-N,N'-bis[4-(1-butyl)-phenyl]-[p-terphenyl]-4,4"-diamine; N,N'-bis(4-t-butylphenyl)-N,N'-bis[4-(1-butyl)-phenyl]-[p-terphenyl]-4,4"-diamine; N,N,N',N'-tetra[4-(1-butyl)-phenyl]-p-terphenyl]-4,4"-diamine; N,N,N',N"-tetra[4-t-butyl-phenyl]-[p-terphenyl]-4,4"-diamine; N,N'-bis(3,4-dimethylphenyl)-4-biphenyl amine; N,N'-diphenyl-N,N'-bis(4-methylphenyl)-1,1'-biphenyl-4,4'-diamine; N,N'-bis(4-methylphenyl)-N,N'-bis(4-ethylphenyl)-1,1'-(3,3'-dimethylbiphenyl)-4,4'-diamine; 4,4'-bis(diethylamino)-2,2'-dimethyl-triphenylmethane; N,N'-diphenyl-N,N'-bis(3-methylphenyl)-[1,1'-biphenyl]-4,4'-diamine (m-TBD); N,N'-diphenyl-N,N'-bis(alkylphenyl)-1,1'-biphenyl-4,4'-diamine; and N,N'-diphenyl-N,N'-bis(chlorophenyl)-1,1'-biphenyl-4,4'-diamine. In specific embodiments, the charge transport molecule in the overcoat layer is m-TBD.

In other embodiments, the overcoat layer solely comprises electrically active or intrinsically charge transporting thermoplastic polymers without the need of charge transport molecules; such materials are well known in the art. Typical electrically active resin materials include, for example, polymeric arylamine compounds and related polymers described in U.S. Pat. No. 4,801,517, U.S. Pat. No. 4,806,444, U.S. Pat. No. 4,818,650, U.S. Pat. No. 4,806,443 and U.S. Pat. No.

5,030,532. Polyvinylcarbazole and derivatives of Lewis acids described in U.S. Pat. No. 4,302,521, the disclosures of which are incorporated herein by reference. Electrically active polymers also include polysilylenes such as poly(methylphenyl silylene), poly(methylphenyl silylene-co-dimethyl silylene), poly(cyclohexylmethyl silylene), poly(tertiarybutylmethyl silylene), poly(phenylethyl silylene), poly(n-propylmethyl silylene), poly(p-tolylmethyl silylene), poly(cyclotrimethylene silylene), poly(cyclotetramethylene silylene), poly(cyclopentamethylene silylene), poly(di-t-butyl silylene-co-dimethyl silylene), poly(diphenyl silylene-co-phenylmethyl silylene), poly(cyanoethylmethyl silylene) and the like. Vinylaromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717 Other polymeric transport materials include-poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516, the disclosures of which are incorporated herein by reference.

In alternative embodiments, the polymer in the overcoat layer may be a thermoset polymer such as, for example, a crosslinked melamine-formaldehyde, a crosslinked polycarbonate, a crosslinked polyamide, and the like.

The overcoat layer may also be one known in the art. For example, it may comprise only a polymeric resin or it may also comprise an amount of charge transporting molecules. It may also contain a small amount of anti-oxidant, such as IRGANOX, to suppress corona species induced LCM problems or an antiozonant to protect against degradation. It may further include nanoparticle dispersions of silica, PTFE, and/or metal oxides to impart wear resistance.

The imaging member may also contain a narrow electrically conductive ground strip (not shown) coated at one edge of the imaging member belt in contact with the charge transport layer, charge generating layer and the conductive layer to effect electrical continuity. Ground strip formulations are well known; they are typically comprised of conductive particles dispersed in a film forming binder.

Although the disclosure has been described with respect to exemplary embodiments, it is not intended to be limited thereto. Those skilled in the art will recognize that variations and modifications including equivalents, substantial equivalents, similar equivalents and the like may be made therein which are within the spirit of the disclosure and the scope of the claims. The development of the present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLES

Conventional Example

A prior art flexible electrophotographic imaging member web was prepared by providing a 0.02 micrometer thick titanium layer coated on a substrate of a biaxially oriented polyethylene naphthalate substrate (KADALEX, available from DuPont Teijin Films) having a thickness of 3.5 mils (89 micrometers). The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and form a crosslinked silane blocking layer. The resulting blocking layer had an average dry thickness of 0.04 micrometers as measured with an ellipsometer.

An adhesive interface layer was then extrusion coated by applying to the blocking layer a wet coating containing 5 percent by weight based on the total weight of the solution of polyester adhesive (MOR-ESTER 49,000, available from Morton International, Inc.) in a 70:30 (v/v) mixture of tetrahydrofuran/cyclohexanone. The resulting adhesive interface layer, after passing through an oven, had a dry thickness of 0.095 micrometers.

The adhesive interface layer was thereafter coated over with a charge generating layer. The charge generating layer dispersion was prepared by adding 1.5 gram of polystyrene-co-4-vinyl pyridine and 44.33 gm of toluene into a 4 ounce glass bottle. 1.5 grams of hydroxygallium phthalocyanine Type V and 300 grams of ⅛-inch (3.2 millimeters) diameter stainless steel shot were added to the solution. This mixture was then placed on a ball mill for about 8 to about 20 hours. The resulting slurry was thereafter coated onto the adhesive interface by extrusion application process to form a layer having a wet thickness of 0.25 mils. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. The wet charge generating layer was dried at 125° C. for 2 minutes in a forced air oven to form a dry charge generating layer having a thickness of 0.4 micrometers.

This coated web stock was simultaneously coated over with a charge transport layer and a ground strip layer by co-extrusion of the coating materials. The charge transport layer was prepared by combining MAKROLON® 5705, a Bisphenol A polycarbonate thermoplastic having a molecular weight of about 120,000, commercially available from Farbensabricken Bayer A.G., with m-TBD in an amber glass bottle in a weight ratio of 1:1 (or 50 weight percent of each).

The resulting mixture was dissolved to give 15 percent by weight solid in methylene chloride. This solution was applied on the charge generating layer by extrusion to form a coating which upon drying in a forced air oven gave a charge transport layer 29 micrometers thick.

The strip, about 10 millimeters wide, of the adhesive layer left uncoated by the charge generating layer, was coated with a ground strip layer during the co-extrusion process. The ground strip layer coating mixture was prepared by combining 23.81 grams of polycarbonate resin (MAKROLON® 5705, 7.87 percent by total weight solids, available from Bayer A.G.), and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the charge transport layer, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the charge transport layer and the ground strip. At this point, the imaging member, having a 29-micrometer thick dried charge transport layer, spontaneously exhibited upward curling into a 1.5-inch tube when unrestrained.

An anti-curl coating was prepared by combining 88.2 grams of polycarbonate resin (MAKROLON® 5705), 7.12 grams VITEL PE-200 copolyester (available from Goodyear Tire and Rubber Company) and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The anti-curl back coating solution was then applied to the rear surface (side opposite the charge generating layer and charge transport layer) of the electrophotographic imaging member web by extrusion coating and dried to a maximum temperature of 125° C. in a forced air oven for 3 minutes to produce a dried anti-curl backing layer having a thickness of 17 micrometers and flatten the imaging member.

Control Example

An electrophotographic imaging member web was prepared as in the Conventional Example, except the anti-curl back coating (ACBC) was not applied. The fabricated imaging member, as a rectangular cut sheet of 12"×12" exhibited spontaneous upward curling into a 1.5-inch tube.

Disclosure Example I

Four electrophotographic imaging member webs were prepared as in the Control Example, except the charge transport layer was modified to contain various amounts of a second charge transport molecule, Tri-p-tolylamine (TTA). By keeping the ratio of total charge transport molecules to MAKROLON® 5705 at a constant of 50:50 weight ratio in the charge transport layer, the TTA replaced the m-TBD to give TTA:m-TBD weight ratios of 34:66, 50:50, 66:34, and 75:25 (Note that m-TBD represents the first charge transport molecule, while TTA represents the second charge transport molecule. Therefore, the TTA:m-TBD ratio is equivalent to the second: first ratio previously discussed.). The resulting imaging members (without an ACBC) were measured for the degree of upward curling as a function of the TTA content in the charge transport layer (CTL). The results thus obtained are listed in Table 1 below:

TABLE 1

| Sample | TTA:m-TBD ratio | Diameter of curvature (inches) | Tg (° C.) |
|---|---|---|---|
| Control Example | 0:100 | 1.5 | 85 |
| Disclosure Example I | 34:66 | 4.5 | 65 |
| Disclosure Example I | 50:50 | 6.25 | 57 |
| Disclosure Example I | 66:34 | Infinity (flat) | 46 |
| Disclosure Example I | 75:25 | Infinity (flat) | 39 |

The data showed that as the TTA:m-TBD weight ratio increased in the CTL, the degree of imaging member upward curling and the Tg both decreased. When the TTA:m-TBD weight ratio was 66:34, the imaging member had no upward curling and was absolutely flat. When the TTA:m-TBD weight ratio was 0:100 (or had no TTA present, same as that of the Control Example), the Tg was 85° C.; when the TTA:m-TBD weight ratio was 66:34, the Tg was 46° C. The observed reduction in the degree of curling was attributed to the combination of the effect of Tg reduction coupled with the decrease in thermal contraction mismatch between the CTL and the substrate support as a consequence of TTA incorporation into the CTL. The CTL of the curl-free imaging member of this disclosure, having no built-in internal strain, should therefore be more resistant to the fatigue bending CTL cracking problem under a normal imaging member belt cyclic functioning conditions in the field.

Disclosure Example II

Two sets of four additional electrophotographic imaging member webs were prepared as described in Disclosure Example I, except the charge transport layer (CTL) was reformulated to include 10 and 25 ppm of Trifluoro Acetic Acid (TFA), respectively, in the CTL to adjust the photoelectrical properties of the resulting imaging members. The photoelectrical results obtained for these two imaging member sets and the control imaging member are given in Table 2 and shown in the four graphs set forth in FIGS. 4-7.

TABLE 2

| | Photoelectric Property | | | | | | | | | | | |
|---|---|---|---|---|---|---|---|---|---|---|---|---|
| TTA:m-TBD | Vr 10K | | | B0 | | | E800-100 | | | A | | |
| Ratio | 0 ppm | 10 ppm | 25 ppm | 0 ppm | 10 ppm | 25 ppm | 0 ppm | 10 ppm | 25 ppm | 0 ppm | 10 ppm | 25 ppm |
| 0:100 | 11 | 10 | 7 | 68 | 77 | 87 | 3.4 | 3.45 | 3.67 | −220 | −211 | −181 |
| 50:50 | 77 | 12 | 6 | 95 | 64 | 20 | 3.9 | 2.79 | 2.55 | −151 | −152 | −167 |
| 66:34 | 108 | 16 | 12 | 110 | 82 | 32 | 4.35 | 2.95 | 2.4 | −169 | −136 | −156 |
| 75:25 | 140 | 95 | 19 | 126 | 112 | 61 | 6.57 | 4.11 | 2.67 | −163 | −128 | −145 |

These results indicate that TFA doping in the CTL successfully adjusted the photoelectrical properties of the fabricated imaging members of the present disclosure to produce properties equivalent to those of the control. The results also show that the addition of a small amount of TFA, in a range of from 10 to 25 ppm levels, to the CTL did not cause any negative impact to the flatness or curl control of the imaging members.

Disclosure Example III

Two electrophotographic imaging member webs were prepared as described in Disclosure Example II. A 3-micron thick overcoat of PCZ-800 with 10 wt % polyvinyl carbazole was applied to one web. A 3-micron thick overcoat of crosslinked bisphenol A carbonate was applied to the other web. Both webs were exposed to corona effluents and both webs were found to resist cracking.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An imaging member, comprising:

a flexible substrate;

a layer comprising a charge transport material, wherein the layer comprises:

a film-forming polymer binder;

trifluoro acetic acid;

a first charge transport molecule selected from the group consisting of biphenyl diamine, terphenyl diamine, and bis(triarylamine) stilbene; and a second charge transport molecule selected from the group consisting of bis(triarylamine); 1,1-bis(4-di-p-tolylaminophenyl)cyclohexane; tri-p-tolylamine; and triphenylamine as represented by Formulas (IV) to (VII) below:

Formula (IV)

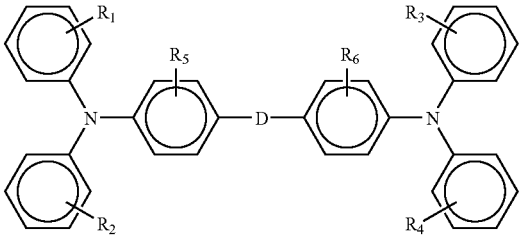

wherein $R_1$ through $R_6$ are independently selected from alkyl having 1 to 3 carbon atoms and hydrogen; and wherein D is a divalent linkage selected from —O—, saturated or unsaturated alkyl having 1 to 8 carbon atoms, substituted alkyl having 1 to 8 carbon atoms, and cycloalkyl having 6 carbon atoms, wherein D is not a phenyl;

Formula (V)

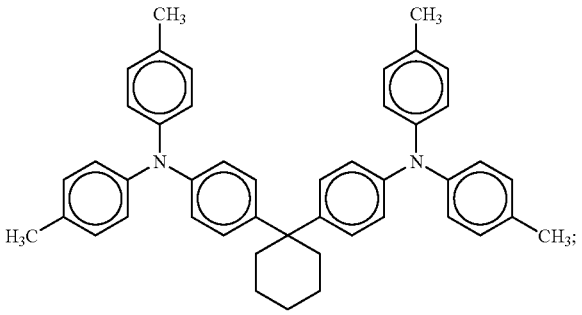

Formula (VI)

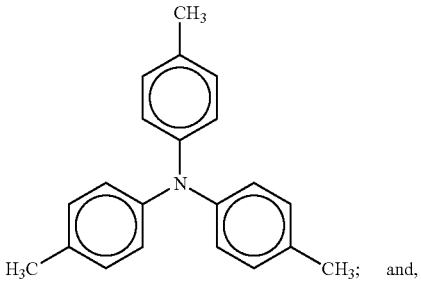

and,

Formula (VII)

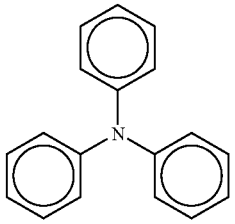

; and an overcoat layer;

wherein the difference in thermal contraction coefficient between the layer comprising a charge transport material and the substrate is from about $+2\times10^{-5}/°$ C. to about $-0.5\times10^{-5}/°$ C. in the temperature range from about the Tg of the layer comprising a charge transport material to about 25° C.; and wherein the imaging member is devoid of an anti-curl back coating.

2. The imaging member of claim 1, wherein the charge transport layer has a glass transition temperature (Tg) of from about 30° C. to about 65° C.

3. The imaging member of claim 2, wherein the charge transport layer has a glass transition temperature (Tg) of from about 35° C. to about 45° C.

4. The imaging member of claim 1, wherein the first charge transport molecule is selected from the group consisting of N,N,N',N'-tetra(o-methylphenyl)-[p-terphenyl]-4,4'-diamine; N,N'-bis(4-methylphenyl)-N,N'-bis[4-(1-butyl)-phenyl]-[p-terphenyl]-4,4'-diamine; N,N'-bis(3-methylphenyl)-N,N'-bis[4-(1-butyl)-phenyl]-[p-terphenyl]-4,4'-diamine; N,N'-bis(4-t-butylphenyl)-N,N'-bis[4-(1-butyl)-phenyl]-[p-terphenyl]-4,4'-diamine; N,N,N',N'-tetra[4-(1-butyl)-phenyl]-[p-terphenyl]-4,4'-diamine; N,N,N',N'-tetra[4-t-butylphenyl]-[p-terphenyl]-4,4'-diamine; N,N'-diphenyl-N,N'-bis(4-methylphenyl)-1,1'-biphenyl-4,4'-diamine; N,N'-bis(4-methylphenyl)-N,N'-bis(4-ethylphenyl)-1,1'-(3,3'-dimethylbiphenyl)-4,4'-diamine; N,N'-diphenyl-N,N'-bis(3-methylphenyl)-[1,1'-biphenyl]-4,4'-diamine (m-TBD); N,N'-diphenyl-N,N'-bis(alkylphenyl)-1,1'-biphenyl-4,4'-diamine; and N,N'-diphenyl-N,N'-bis(chlorophenyl)-1,1'-biphenyl-4,4'-diamine.

5. The imaging member of claim 4, wherein the first charge transport molecule is selected from the group consisting of m-TBD and N,N,N',N'-tetra(o-methylphenyl)-[p-terphenyl]-4,4'-diamine.

6. The imaging member of claim 1, wherein the second charge transport molecule is tri-p-tolylamine.

7. The imaging member of claim 1, wherein the second charge transport molecule is 1,1-bis(4-di-p-tolylaminophenyl)cyclohexane.

8. The imaging member of claim 1, wherein the first charge transport molecule is selected from the group consisting of Formulas (I), (II), and (III) below:

Formula (I)

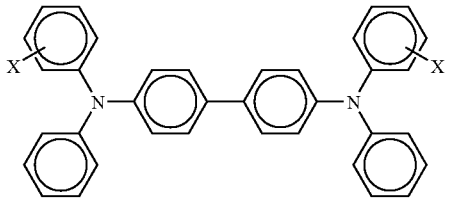

wherein X is selected from the group consisting of alkyl, hydroxyl, and halogen;

Formula (II)

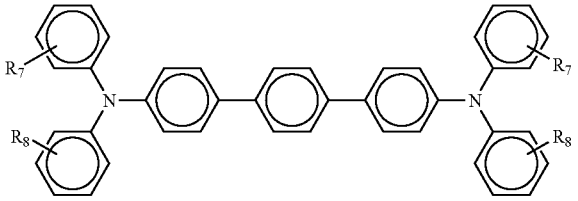

wherein $R_7$ and $R_8$ are independently selected from the group consisting of alkyl, hydroxyl, and halogen;

Formula (III)

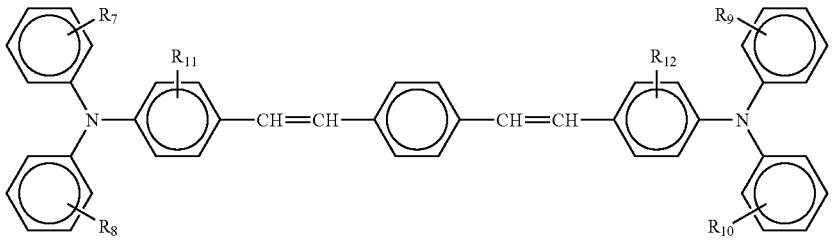

wherein $R_7$ through $R_{12}$ are independently selected from the group consisting of hydrogen, halogen, alkyl having 1 to 3 carbon atoms, aryl having 6 to 10 carbon atoms, and cycloalkyl having 3 to 18 carbon atoms.

9. The imaging member of claim 1, wherein the ratio of second charge transport molecule to first charge transport molecule is from about 90:10 to about 55:45.

10. The imaging member of claim 1, wherein the ratio of second charge transport molecule to first charge transport molecule is from about 90:10 to about 60:40.

11. The imaging member of claim 1, wherein the film-forming polymer binder is a polycarbonate selected from the group consisting of a poly(4,4'-isopropylidene diphenyl)carbonate represented by Formula (VIII) below, Formula (VIII)

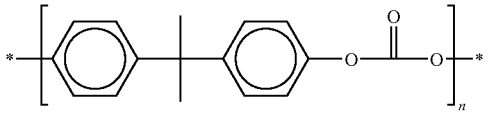

a poly(4,4'-diphenyl-1,1'-cyclohexane) carbonate represented by Formula (IX) below, Formula (IX)

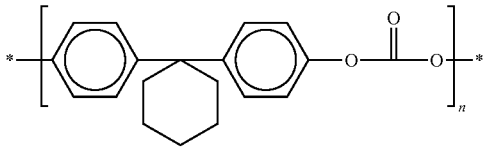

and a polyphthalate carbonate represented by Formula (X) below,

Formula (X)

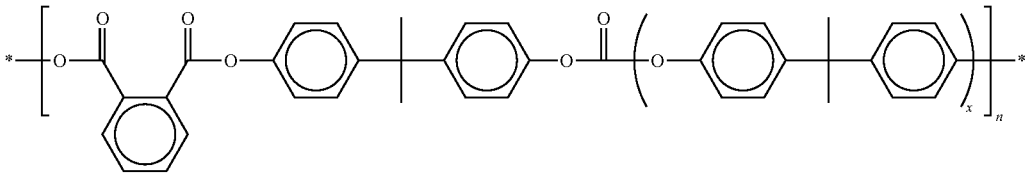

wherein x is an integer from about 1 to about 10, n is the degree of copolymerization, and n is a number of from about 50 to about 300.

12. The imaging member of claim 1, wherein the trifluoro acetic acid (TFA) is present in an amount of from about 5 ppm to about 30 ppm.

13. The imaging member of claim 12, wherein the trifluoro acetic acid (TFA) is present in an amount of from about 10 ppm to about 25 ppm.

14. The imaging member of claim 1, wherein the layer comprising the charge transport material comprises from about 25 wt % to about 75 wt % of charge transport molecules and from about 75 wt % to about 25 wt % of the film-forming polymer binder, both by total weight of the layer.

15. The imaging member of claim 1, wherein the overcoat layer comprises a crosslinked bisphenol A carbonate.

16. The imaging member of claim 15, wherein the overcoat layer further comprises a charge transport molecule in the amount of from about 1 weight percent to about 10 weight percent, based on the weight of the dried overcoat layer.

17. A method of imaging which comprises generating an electrostatic latent image on the imaging member of claim 1, developing the latent image and transferring the developed electrostatic image to a suitable substrate.

18. A flexible imaging member, comprising:

a flexible substrate, wherein an electrically conductive layer is present when the substrate is not electrically conductive;

a charge generating layer;

a charge transport layer, the charge transport layer comprising:

a film-forming polymer binder;

trifluoro acetic acid (TFA) in an amount of from about 10 ppm to about 25 ppm;

a first charge transport molecule which is N,N'-diphenyl-N,N'-bis(3-methylphenyl)-[1,1'-biphenyl]-4,4'-diamine; and a second charge transport molecule selected from the group consisting of tri-p-tolylamine; 1,1-bis(4-di-p-tolylaminophenyl)cyclohexane; and triphenylamine;

wherein the ratio of second charge transport molecule to first charge transport molecule is from about 90:10 to about 66:34;

wherein the difference in thermal contraction coefficient between the charge transport layer and the substrate is from about $+2\times10^{-5}/°$ C. to about $-0.5\times10^{-5}/°$ C. in the temperature range between the Tg of the charge transport layer and 25° C.; and a protective overcoat layer;

wherein the imaging member tails to comprise an anti-curl back coating.

19. An image-forming apparatus, comprising:

a flexible electrophotographic imaging member having a charge retentive surface to receive an electrostatic latent image thereon, wherein the imaging member comprises:

a flexible substrate, wherein an electrically conductive layer is present when the substrate is not electrically conductive;

a charge generating layer;

a charge transport layer comprising:

a film-forming polymer binder;

trifluoro acetic acid (TFA) in an amount of from about 10 to about 25 ppm;

a first charge transport molecule selected from the group consisting of biphenyl diamine, terphenyl diamine, and bis(triarylamine) stilbene; and a second charge transport molecule selected from the group consisting of a bis(triarylamine); 1,1-bis(4-di-n-tolylaminophenyl)cyclohexane; tri-p-tolylamine; and triphenylamine as represented by Formulas (IV) to (VII) below:

Formula (IV)

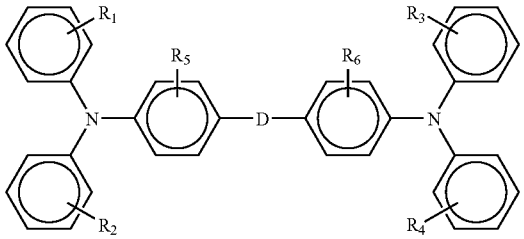

wherein $R_1$, through $R_6$ are independently selected from alkyl having 1 to 3 carbon atoms and hydrogen; and wherein D is a divalent linkage selected from —O—, saturated or unsaturated alkyl having 1 to 8 carbon atoms, substituted alkyl having 1 to 8 carbon atoms, and cycloalkyl having 6 carbon atoms, wherein D is not phenyl;

Formula (V)

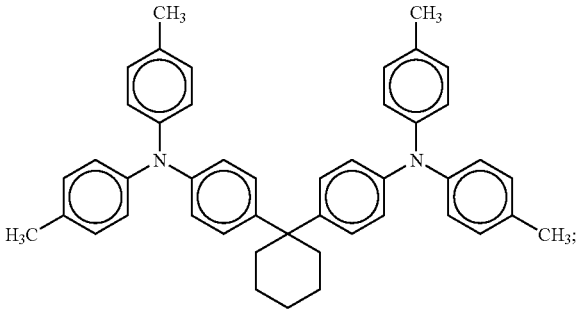

Formula (VI)

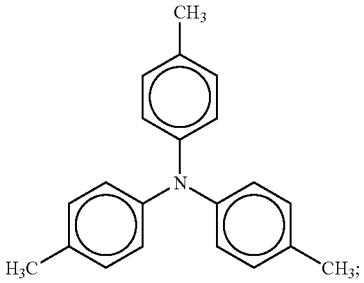

and,

Formula (VII)

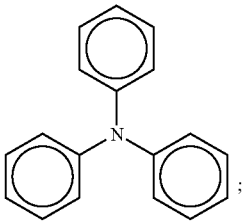

wherein the difference in thermal contraction coefficient between the charge transport layer and the substrate is from about $+2\times10^{-5}/°$ C. to about $-0.5\times10^{-5}/°$ C. in the temperature range between the Tg of the charge transport layer and 25° C.; and a protective overcoat layer;

wherein the imaging member is devoid of an anti-curl back coating;

a development component to apply a developer material to the charge-retentive surface to develop the electrostatic latent image to form a developed image on the charge-retentive surface;

a transfer component for transferring the developed image from the charge-retentive surface to another member or a copy substrate; and a fusing member to fuse the developed image to the copy substrate.

* * * * *